US006050111A

United States Patent [19]

Nosaka et al.

[11] Patent Number: 6,050,111

[45] Date of Patent: Apr. 18, 2000

[54] GUIDE DRIVE DEVICE IN WARP KNITTING MACHINE

[75] Inventors: Norimasa Nosaka; Hiroshi Narushima, both of Fukui, Japan

[73] Assignee: Nippon Mayer Co., Ltd., Fukui, Japan

[21] Appl. No.: 09/171,200

[22] PCT Filed: Feb. 26, 1998

[86] PCT No.: PCT/JP98/00771

§ 371 Date: Oct. 14, 1998

§ 102(e) Date: Oct. 14, 1998

[87] PCT Pub. No.: WO98/38368

PCT Pub. Date: Sep. 3, 1998

[30] Foreign Application Priority Data

Feb. 26, 1997 [JP] Japan ..... 9-041715
Mar. 13, 1997 [JP] Japan ..... 9-058654

[51] Int. Cl.[7] ..... D04B 27/10

[52] U.S. Cl. ..... 66/207; 66/204

[58] Field of Search ..... 66/204, 205, 206, 66/207, 125 K, 203

[56] References Cited

U.S. PATENT DOCUMENTS

| | | |
|---|---|---|
| 3,044,283 | 7/1962 | Liebchen . |
| 3,247,686 | 4/1966 | Lanthier . |
| 3,478,543 | 11/1969 | Faninger . |
| 3,665,733 | 5/1972 | Jackson . |
| 3,678,711 | 7/1972 | Schneider et al. . |
| 3,729,954 | 5/1973 | Ducol . |
| 3,978,690 | 9/1976 | Beling et al. . |
| 4,051,698 | 10/1977 | Leonhardt . |
| 4,831,862 | 5/1989 | Ohashi et al. . |
| 4,876,862 | 10/1989 | Zorini . |
| 5,140,841 | 8/1992 | Offermann et al. . |
| 5,259,216 | 11/1993 | Zorini . |
| 5,295,372 | 3/1994 | Kemper et al. . |
| 5,307,648 | 5/1994 | Forkert et al. . |
| 5,311,751 | 5/1994 | Winter et al. . |
| 5,311,752 | 5/1994 | Gille . |
| 5,327,750 | 7/1994 | Speich . |
| 5,331,828 | 7/1994 | Weis et al. . |
| 5,353,611 | 10/1994 | Wade et al. . |
| 5,390,513 | 2/1995 | Haegel et al. . |
| 5,473,913 | 12/1995 | Bogucki-Land . |
| 5,502,987 | 4/1996 | Zorini . |
| 5,553,470 | 9/1996 | Hohne et al. . |
| 5,675,993 | 10/1997 | Ono et al. . |
| 5,709,108 | 1/1998 | Ono et al. . |
| 5,775,134 | 7/1998 | Otobe et al. ..... 66/207 |
| 5,855,126 | 1/1999 | Otobe et al. . |
| 5,862,683 | 1/1999 | Otobe et al. . |
| 5,873,267 | 2/1999 | Otobe et al. ..... 66/207 |

FOREIGN PATENT DOCUMENTS

| | | |
|---|---|---|
| 47-18061 | 5/1972 | Japan . |
| 49-49321 | 5/1974 | Japan . |
| 55-152847 | 11/1980 | Japan . |
| 59-4065 | 2/1984 | Japan . |
| 6-49754 | 2/1994 | Japan . |
| 8-296157 | 11/1996 | Japan . |

*Primary Examiner*—Danny Worrell
*Attorney, Agent, or Firm*—Jordan and Hamburg

[57] ABSTRACT

A guide drive device permits compact reception of a greater number of guide bars and nests within an existing installation space at a side portion of a knitting machine, by disposition of a drive source for guide attaching members in a space above a fan-shaped arrangement. A support member, attached to a machine frame, is provided with the drive source on the upper side of guide bars, directly, or via a base bar which constitutes an attaching and holding member. The guide bars are displaceable by operation of the drive source, and are arranged in parallel ranks successive in a direction intersecting with knitting needle rows. An angle of circumference can thereby be reduced for enhanced use of available space. The nest angle can be further reduced for improved patterning function surpassing that of a conventional Multi-bar Raschel machine by tightly fastening thread feed guides of the guide attaching members to driving long members respectively carrying out independent shogging motions.

13 Claims, 16 Drawing Sheets

GUIDE DRIVE DEVICE IN WARP KNITTING MACHINE

TECHNICAL FIELD

The present invention relates to a device for driving a thread feed guide, particularly a thread feed guide for patterning which is installed in a warp knitting machine for carrying out desired knitting by leading knitting yarn to a knitting needle.

BACKGROUND ART

In recent years, when a guide bar for supporting a guide needle for feeding thread in a warp knitting machine is concerned, with further complication and size increase of pattern constitution of lace fabric for clothing, a number of so-to-speak pattern guide bars for leading patterning yarns that form pattern structure is increased, in relation to ground guide bars for leading ground yarns that form ground fabric among knitting yarns to be led.

Currently, there has emerged a warp knitting machine referred to as Multibar Raschel having substantially eighty sheets of pattern guide bars.

Under the situation, there is no bounds in insatiable intention for high grade formation of lace pattern and even in the current state, the market is in pursuit of bringing forth gorgeous lace of wide width lace having a dense and complicated pattern constitution which is equivalent to that of slender width lace by further increasing the number of pattern guide bars.

However, as is well known, a pattern guide bar is constructed by constituting a nesting structure (fan shape arrangement, which is referred to as nesting or nest) around a knitting needle row of guide needles (refer to FIG. 20). In FIG. 20, numeral 501 designates a support member fixed to a machine frame 502. Notations 514*a*, 514*b*, 514*c*, 514*d*, 514*e* and 514*f* designate thread feed guides of one unit of nesting, that is, thread feed guides of a nest constituted by taking a set of guides in which thread guide holes of distal ends of guide needles are aligned in one row. Notation N designates the knitting needle row.

Because of the above-described structure, although a number of nests (units) of pattern guide bars can further be increased when enlargement of a motional range of the knitting needles and occupied areas of the guide bars as well as lowering of a rotational number are not considered, the volume of a warp knitting machine is restricted in view of a size of a building and with regard to rotational number, conceivably, the number is not significantly lowered but is increased in view of economic performance.

Attempts have been made to increase the number of guide bars without increasing a nest angle θ between a face of a thread feed guide (guide needle and its support portion) for attaching to a frontmost guide bar in one unit of a conventional nest, and a face of the thread feed guide for attaching to a rearmost guide bar. No increase of nest angle θ means no significant change of a height of a warp knitting machine and a width thereof in the front and rear direction.

For example, JP-B-47018061 (Japanese Examined Patent Publication No. 47-18061) discloses a guide structure in a warp knitting machine having a constitution in which bar-like members each in correspondence with a guide bar for attaching a thread feed guide of guide needles and the like are held in plural ranks successive in the up and down direction and slidably in the width direction of the warp knitting machine in respect of a lead hanger attached to a plurality of hangers in a fan shape constituting a support member by which a number of the bar-like members for attaching the thread feed guide is increased without increasing a necessary space in respect of a reed oscillating direction (front and rear direction of warp knitting machine).

However, in this case, driving means for causing displacement of the bar-like member comprises pattern wheels, chain links and so on installed at a side portion of the warp knitting machine similar to those in the conventional case of driving reed and accordingly, a comparatively large installation space is needed.

Further, JP-A-06049754 (Japanese Unexamined Patent Publication No. 6-49754) discloses a constitution for driving a guide bar (thread leading reed) for attaching a thread feed guide in which pattern wheels, chain links and the like are not installed at a side portion of a warp knitting machine as in the conventional case but a linear motor is installed at one end of the guide bar to be able to drive directly.

In this case, not only the driving means is invariably installed at the side portion of the warp knitting machine but there poses a problem similar to that of the conventional nesting structure by the fan shape arrangement of guide bar.

Further, in the case of a guide driving device disclosed in PCT WO 95/19362, a thread feed guide is movably installed to a holding member having a guide path and the thread feed guide is moved by driving means of a linear motor or the like. However, a total nest number is not increased more than that of a conventional Multibar Raschel machine of a guide bar directly driving type. Accordingly, in one repeat width of a pattern, a number of guides capable of intersecting at a time of shogging motion of a thread feed guide for pattern cannot be increased.

Hence, it is a first object of the present invention to provide a guide drive device which is capable of increasing a number of guide attaching members such as guide bars or the like and the nest number within a conventional installation space, and which needs no large space at a side portion of a warp knitting machine by installing a drive source thereof (displacement causing means) by effectively utilizing a space above fan shape arrangement.

Meanwhile, even when guide attaching members such as guide bars or the like are arranged in plural ranks, if each one guide attaching member is driven by one guide path, in order to further increase a number of guide attaching members, guide paths must be added in the longitudinal direction of the thread feed guide, with thread lead holes at distal ends of the thread feed guides as start points. Therefore, an extremely long thread feed guide needs to be used and there is a limitation in further increasing the nest number.

Hence, it is a second object of the present invention to provide a guide drive device in a novel warp knitting machine having patterning function comparable to or surpassing a drive device of a thread feed guide for patterning in a Multibar Raschel machine having one hundred sheets or more of pattern reeds which has not been realized yet.

DISCLOSURE OF THE INVENTION

According to a first aspect of the present invention, there is provided a guide drive device in a warp knitting machine comprising support members attached to machine frames, displacement causing means attached to the support members directly, or via attaching and holding members, guide attaching members connected to the displacement causing means and installed to be able to displace in a direction of extending knitting needle rows by the means, and wherein the guide attaching members are installed in plural ranks in parallel with a direction intersecting with the knitting needle rows and a displacement can be caused for each of the guide attaching members.

Thereby, a number of the guide attaching members and the nest number can be increased without increasing an angle of fan shape arrangement of a set of nests (a set where thread lead holes at distal ends of guide needles are arranged in one row, the same applies in the following), that is, the nest angle in a range of the fan shape arrangement in restrictedly arranging the guide attaching members and further, the displacement causing means can be accommodated by utilizing upper space in the nest angle for installing the fan shape arrangement. Therefore, the displacement causing means is not provided at a side portion of the warp knitting machine and the nest angle for installing one guide attaching unit can considerably made smaller than that of a conventional device having the same number of sheets. Accordingly, there can be provided a warp knitting machine where guide attaching members are significantly increased in accordance with a number of the guide attaching units capable of being installed in an allowable installation space of the warp knitting machine.

The guide attaching member can be constituted by a guide bar attached with a single or a plurality of thread feeding guide needles. Thereby, there can be provided a warp knitting machine in which guide bars are significantly increased in accordance with a number of guide attaching units installed in the allowable installation space of the warp knitting machine.

According to the above-described guide drive device in which the displacement causing means is attached via the attaching and holding member, it is advantageous for a structure for supporting and sliding guide needles attached to the guide bar to constitute the attaching and holding member by a base bar attached to the support members and extended in a direction in parallel with the knitting needle rows and the guide bar is attached to the base bar in a state in parallel with the base bar.

According to the guide drive device, it is preferable to provide slide rails at a portion of lower edge of the base bar or the like and install the guide needle attached to the guide bar slidably along the slide rails.

Thereby, the guide needle is supported by the guide bar and the slide rails and even in the case of a long guide needle, a stabilized attaching state is provided and accordingly, deflection of a distal end of the guide needle is not caused and an accurate knitting state can be provided.

When the guide bars are installed in plural ranks on both sides of the base bar, a space in a range of an angle of circumference for installing the guide bar units can be utilized most effectively.

Further, by bringing the base bar arranged with the guide bars on the both sides into a state where the guide needles are attached to one side of the guide bars, that is, attached to a front end side of the warp knitting machine or a rear side thereof, operation of attaching screws in detachment, attachment, adjustment or the like of the guide needle is facilitated.

Further, by adopting at least one of a servo motor, a linear motor and a piezoelectric element as the displacement causing means, compact formation in installing space can be achieved, displacement of the guide bar can freely be controlled by electronic control and expansion of pattern constitution can be achieved by dispensing with restriction of lapping.

Further, according to a second aspect of the present invention, there is provided a guide drive device in a warp knitting machine comprising an attaching and holding member supported by supporting members in parallel with knitting needle rows and having a plurality of rows of guide portions, a plurality of guide attaching members attached with thread feed guides at sliding portions respectively arranged slidably in a direction of extending the knitting needle rows at the respective guide portions of the attaching and holding member, a plurality of driving long members arranged in the direction of the knitting needle rows along the sliding portions of the guide attaching members and fixed to the guide attaching members by being interposed between the sliding portions and the thread feed guides, wherein motions independently from each other are caused at the plurality of the guide attaching members and/or the thread feed guides arranged at one of the guide portions.

According to the aspect of the present invention, the nest number can be increased more than that of a Multibar Raschel machine based on a conventional reed structure and accordingly, a number of thread feed guides capable of intersecting in shogging motion is increased, driving means of a motor or the like for displacing guide is connected to the thread feed guide via a driving long member and accordingly, the problem of heat generation at a surrounding of the thread feed guide for the mislapping is also resolved.

Further, the driving long members of a number of thread feed guides are arranged in one unit of a nest and respectively independent shogging motions can be carried out in a plurality of guide attaching members arranged in guide portions by the respectives and accordingly, in the case of producing slender width lace fabric, different patterns can simultaneously be knitted at each pattern repeat width of about 12 kinds or 20 kinds.

Further, by using several nests on the front side of the warp knitting machine among a total of nests of thread feed guides, even in the case of producing lace fabric capable of sufficiently competing with lace fabric produced by a Multibar Raschel machine of a conventional system, thread feed guides need not to attach to nests on the rear side of a warp knitting machine and only nests on the front side of the warp knitting machine which are not inclined so much to the horizontal direction may be used.

Further, according to the above-described guide drive device, the plurality of rows of guide portions in the attaching and holding member are installed in parallel with each other, in plural ranks and in a direction intersecting with the knitting needle rows from adjacent to remote in view from thread lead holes at distal ends of the thread feed guides and the respective guide attaching members arranged in the guide portions are arranged to successively shift positions of the guide portions or the thread feed guides in a direction intersecting with faces for attaching the guide attaching members to prevent mutual interference at vicinities of the guide portions.

Thereby, the thread feed guides arranged at different guide portions in the same nest, can be made adjacent to each other up to immediately before the guide needles are brought into contact with each other. Further, an angle made by the guide needles of the thread feed guides on both left and right sides of each nest viewed from the side face of the warp knitting machine (hereinafter, referred to as nest angle) is made smaller than a nest angle by guide needles of thread feed guides attached to pattern guide bars on both left and right sides of 4 sheets or 6 sheets of pattern guide bars in a Multibar Raschel machine.

Further, the above-described guide portions may be constituted to install on both side faces of the attaching and holding member. In this case, a nest having a number exceeding a limit of a number of a nest in a Multibar Raschel machine can be arranged within an angle range by nesting of conventional fan shape arrangement and the patterning function thereby surpasses that of a kind of a machine even when the kind of machine simply adding the nest number of a Multibar Raschel machine, is assumed to be able to realize.

There can be provided a constitution in which a plurality of driving long members are provided to one guide portion in the attaching and holding member, each of the guide attaching members arranged to the guide portions, that is, the thread feed guide is attachably and detachably fixed to at least one of the driving long members. Thereby, detachment and attachment operation for interchanging the respective thread feed guides can easily be carried out.

Further, when a single one of the thread feed guides is fixed to the driving long member of the thread feed guide moving in the same way via the sliding portion, motion of the thread feed guide can be stabilized.

Further, by constituting the driving long member of the thread feed guide by a wire, respectively independent motions of a plurality of thread feed guides attached to one guide portion can be carried out smoothly and a number of the wires are arranged in one nest and accordingly, a number of thread feed guides capable of moving independently can be increased.

BEST MODE FOR CARRYING OUT THE INVENTION

An explanation will be given of an embodiment of a guide drive device in a warp knitting machine according to a first aspect of the present invention in reference to the drawings.

Figure 1:
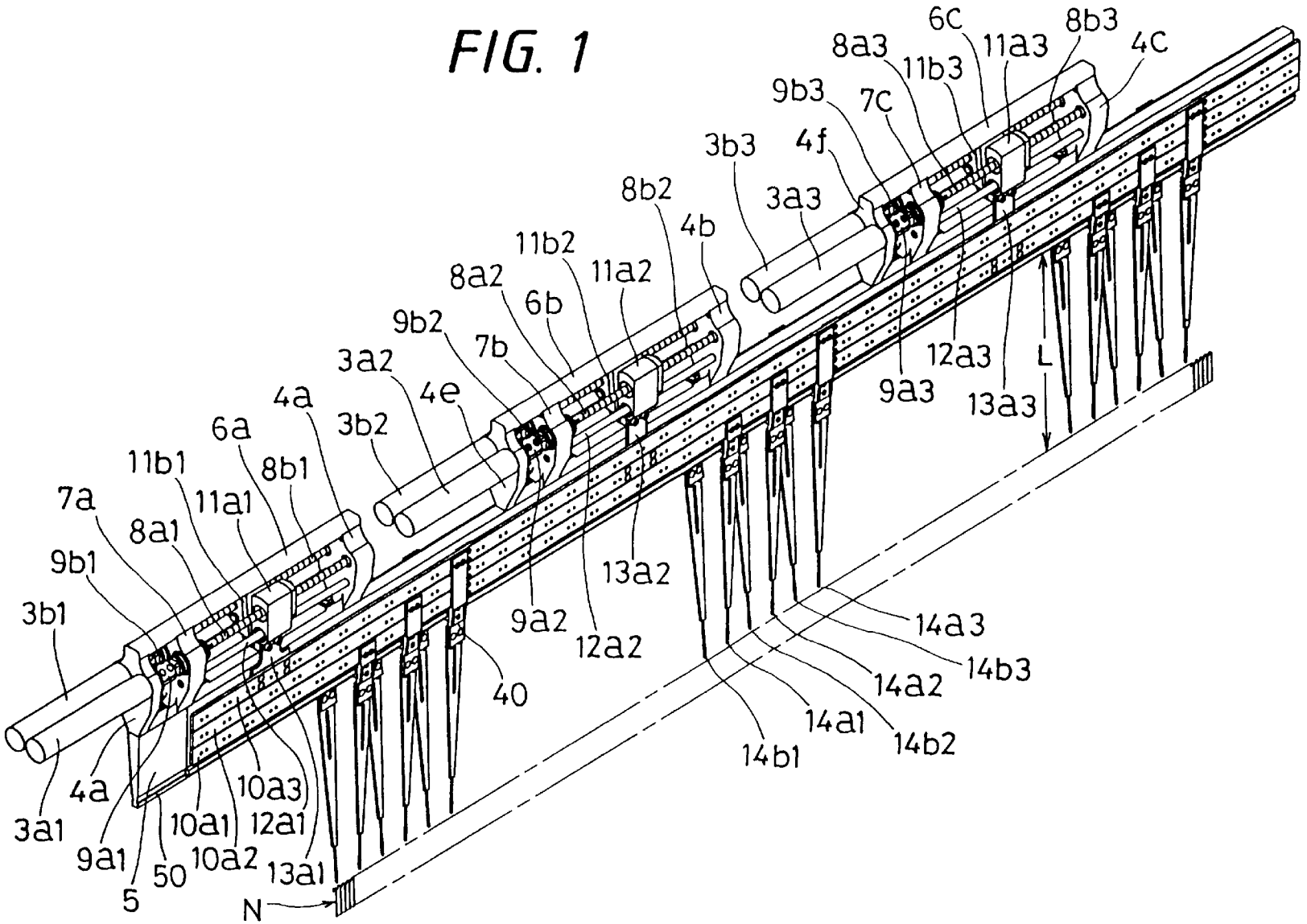
FIG. 1 is a perspective view of one unit of a guide attaching member showing an embodiment of a guide drive device according to a first aspect of the present invention.
Figure 2:
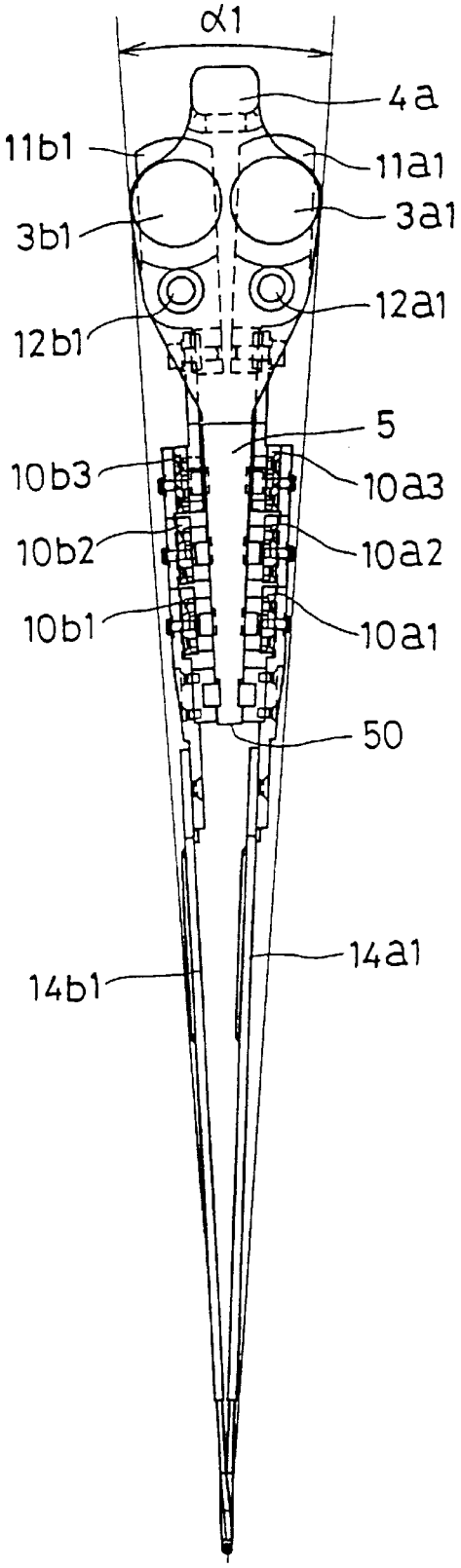
FIG. 2 is a side view of the unit of the guide attaching member of FIG. 1.
Figure 3:
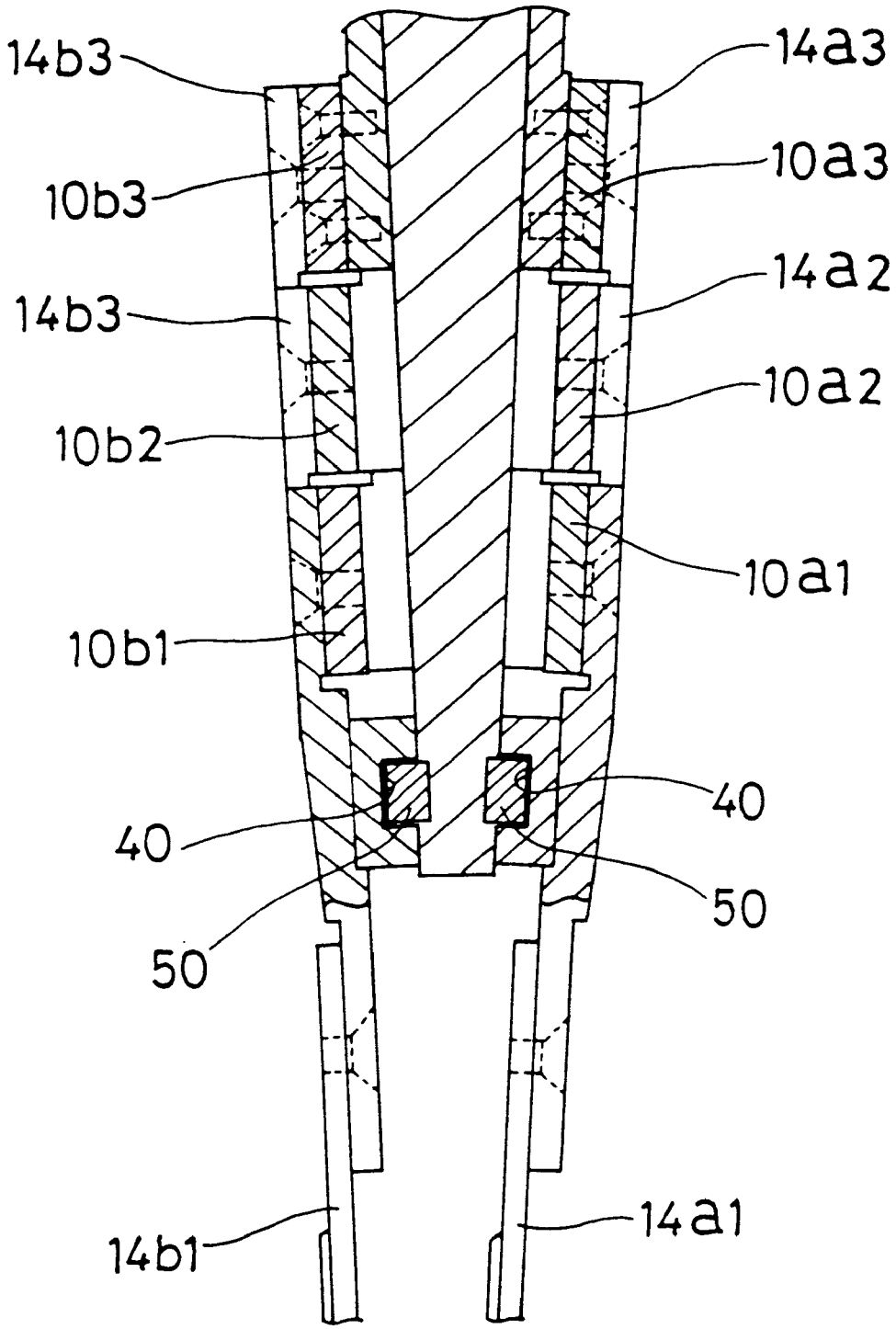
FIG. 3 is a view enlarging a section of a portion of the former drawing.
Figure 4:
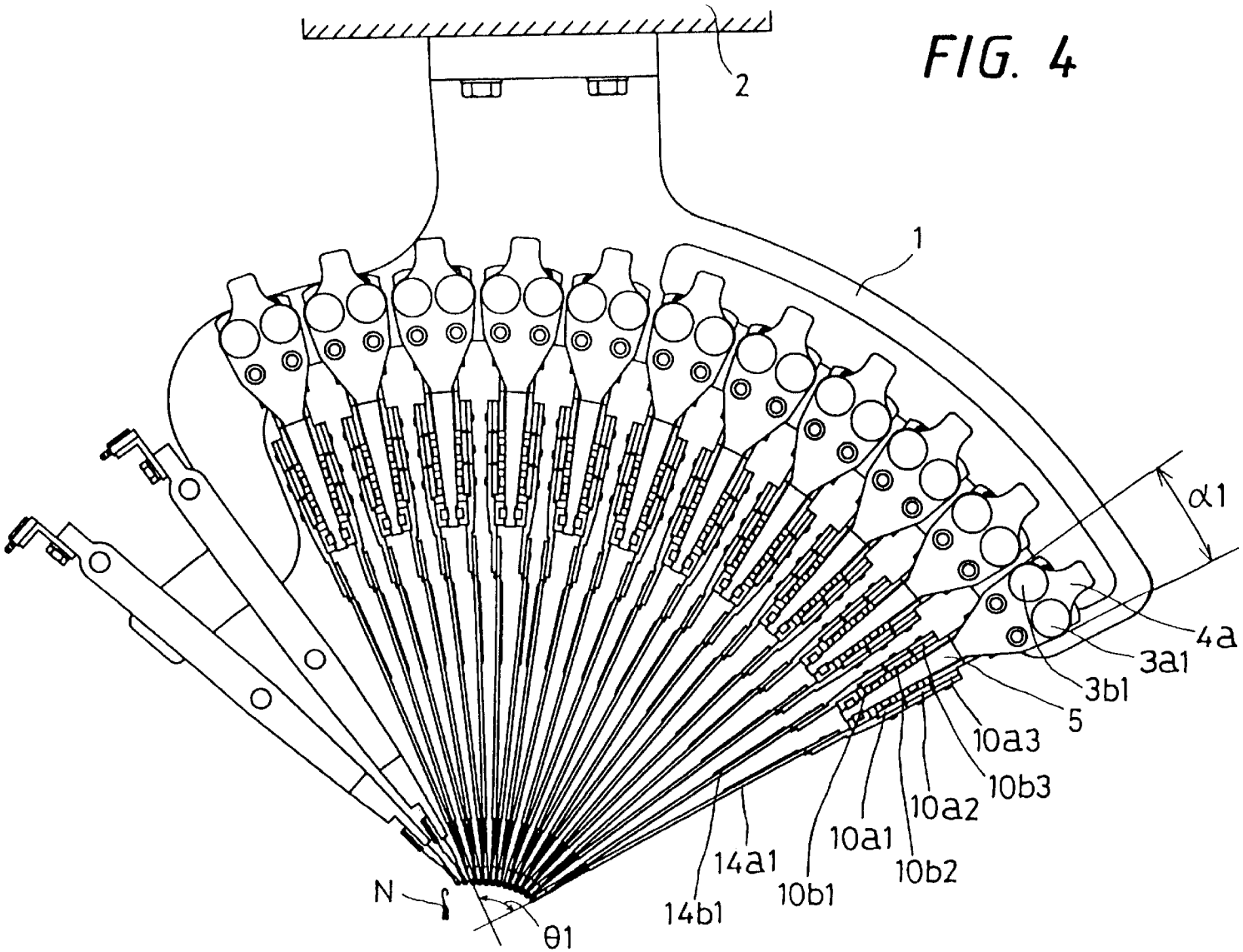
FIG. 4 is a side view of essential portions for knitting of a warp knitting machine having eleven rows of units of guide attaching members according to the embodiment.

FIG. 1 through FIG. 4 show an embodiment of a guide drive device in the case where a guide attaching member is a guide bar addingly attached with a guide needle for feeding thread. FIG. 1 shows a perspective view of one unit (guide bar unit) that corresponds to one set of nests equipped with a plurality of guide attaching members, that is, guide bars. FIG. 2 shows a side view thereof, FIG. 3 shows a view enlarging a section of a portion thereof and FIG. 4 shows a side view of essential portions for knitting of a warp knitting machine having eleven rows of the guide bar units according to the embodiment.

Numeral 1 in FIG. 4 designates a support member. Normally, a plurality thereof are fixedly screwed to a machine frame 2 referred to as traverse hangingly installed to left and right machine frames (not illustrated), at a central portion of a warp knitting machine at pertinent intervals in the width direction of the warp knitting machine. The support member 1 is also referred to as hanger since it is hung to the machine frames, and there is a case in which it is fixed as in this embodiment and a case in which it is fixed to a pivoting hanger shaft and can be swung in the front and rear direction of the warp knitting machine.

As shown by FIG. 1 through FIG. 4, in the case of the embodiment, a total of six of servo motors 3*a*1, 3*b*1, 3*a*2, 3*b*2, 3*a*3 and 3*b*3 in a cylindrical shape are installed as displacement causing means by being paired in twos. Naturally, these servo motors are pertinently increased in accordance with the length of the guide bar.

Numeral 5 designates a base bar as an attaching and holding member which is installed to extend in a direction in parallel with a knitting needle row N. Support portions 4*a*, 4*b* and 4*c* erected on the upper-side face of the base bar 5 are fixedly screwed to the support member 1. Notations 4*d*, 4*e* and 4*f* designate similarly support portions which are erected on the upper-side face of the base bar 5 with intervals from the respective support portions 4*a,* 4*b* and 4*c* and the respective support portions are connected by connecting members 6*a,* 6*b* and 6*c* for reinforcement. Notations 7*a,* 7*b* and 7*c* designate bearing metals which are respectively fixed on the upper-side face of the base bar 5 to support ball screw shafts 8*a*1, 8*b*1, 8*a*2, 8*b*2, 8*a*3 and 8*b*3 which are respectively arranged in parallel with the base bar between the support potion 4*d* and support portion 4*a,* the support portion 4*e* and the support portion 4*b* and the support portion 4*f* and the support portion 4*c*. Notations 9*a*1, 9*b*1, 9*a*2, 9*b*2, 9*a*3 and 9*b*3 designate couplings of output shafts of the respective servo motors 3*a*1, 3*b*1, 3*a*2, 3*b*2, 3*a*3 and 3*b*3 which are the displacement causing means with the respective ball screw shafts 8*a*1, 8*b*1, 8*a*2, 8*b*2, 8*a*3 and 8*b*3.

Notations 10*a*1, 10*a*2 and 10*a*3 designate guide bars which are installed in plural ranks, for example, three ranks as in the illustrated embodiment, successive in the up and down direction constituting a direction intersecting with the knitting needle row N on the front side of the base bar 5, while notations 10*b*1, 10*b*2 and 10*b*3 designate guide bars similarly installed in three ranks successive in the up and down direction constituting the direction intersecting with the knitting needle row N on the rear side of the base bar 5.

Notations 11*a*1, 11*b*1, 11*a*2, 11*b*2, 11*a*3 and 11*b*3 designate sliders which are respectively fitted to the ball screw shafts 8*a*1, 8*b*1, 8*a*2, 8*b*2, 8*a*3 and 8*b*3 and in which female screws in mesh with the respective ball screw shafts are installed such that reciprocating displacement is caused by left and right rotation of the respective ball screw shafts. Notations 12*a*1, 12*a*2, 12*a*3 and 12*b*1 designate slide shafts fitted with the sliders 11*a*1, 11*a*2, ll*a*3 and 11*b*1. Further, sliders 11*b*2 and 11*b*3 are fitted to slide shafts which are concealed in the drawing.

The guide bar 10*a*1 and the slider 11*a*3, the guide bar 10*a*2 and the slider 11*a*2 and the guide bar 10*a*3 and the slider 11*a*1 are screwedly coupled respectively via connecting pieces 13*a*3, 13*a*2 and 13*a*1. Further, the guide bar 10*b*1 and the slider 11*b*3, the guide bar 10*b*2 and the slider 11*b*2 and the guide bar 10*b*3 and the slider 11*b*1 are screwedly coupled respectively via connecting pieces concealed in the drawing.

Notations 14*a*1, 14*b*1, 14*a*2, 14*b*2, 14*a*3 and 14*b*3 designate thread feed guides (hereinafter, simply referred to as guides in this embodiment) each comprising a guide needle for feeding thread having a thread lead hole at its distal end, and a supporter of the guide needle. Among them, the guide 14*a*1 is fixedly mounted to the guide bar 10*a*1, and the guide 14*b*1 is fixedly mounted to the guide bar 10*b*1 respectively by screws. Same way goes on with the guide 14*a*2 to the guide bar 10*a*2, the guide 14*b*2 to the guide bar 10*b*2, the guide 14*a*3 to the guide bar 10*a*3 and the guide 14*b*3 to the guide bar 10*b*3. A plurality of the respective guides are attached to the respective guide bars at same attaching intervals in accordance with a number of times of repeating a pattern in a pattern constitution. Each of the guides is fixedly screwed to each of the guide bars and recess portions 40 provided at a portion of the guide are fitted to slide rails 50 provided at a lower edge of the base bar 5 in a relationship of male and female with the recess portions 40 by which vibration and deflection of the guide in the front and rear direction of the warp knitting machine can be prevented.

Figure 5:
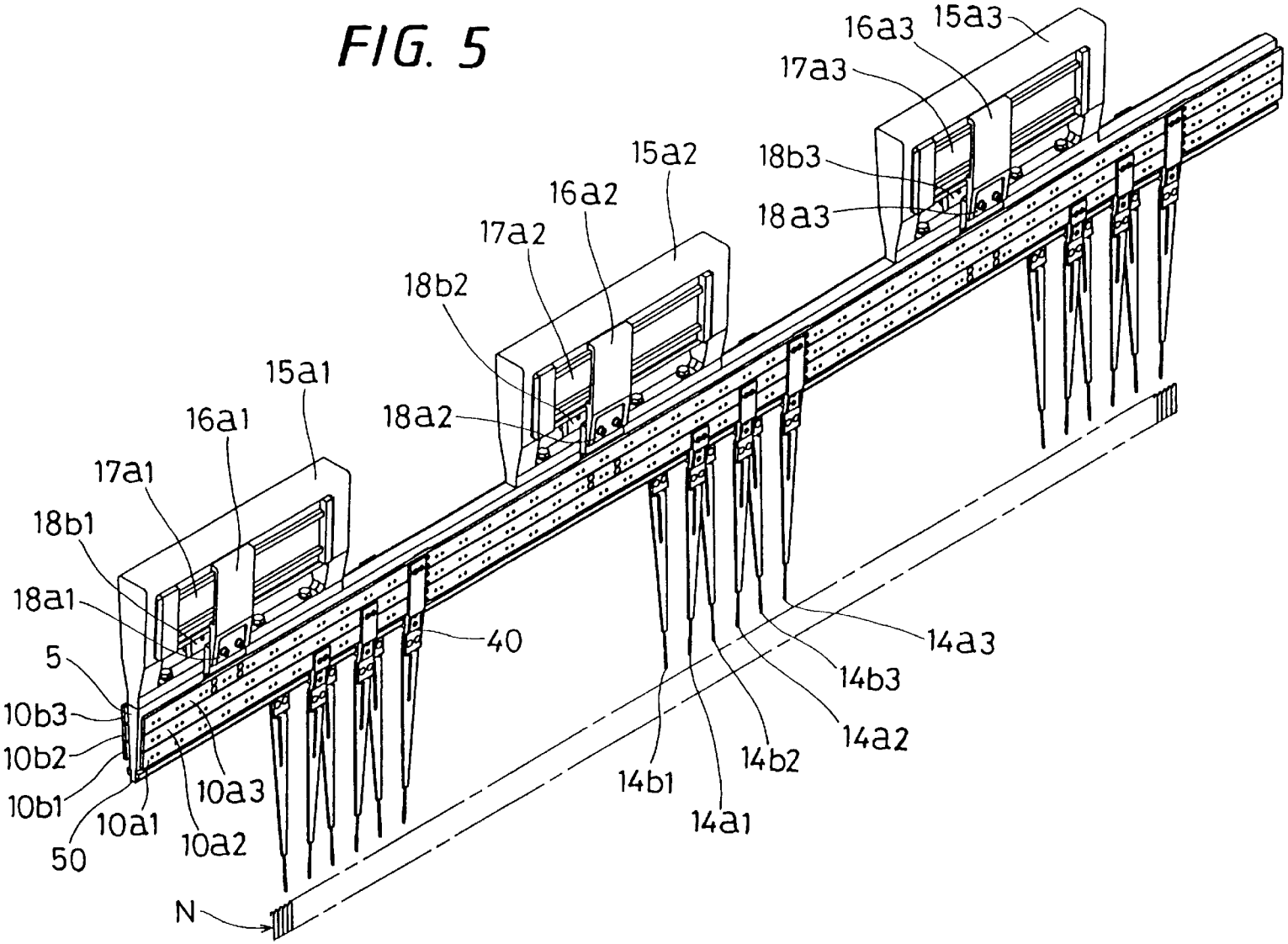
FIG. 5 is a perspective view of one unit of a guide attaching member showing other embodiment of a guide drive device according to the first aspect of the present invention.

Whereas according to the above-described embodiment, the servo motors 3 (3*a*1, 3*b*1, 3*a*2, 3*b*2, 3*a*3, 3*b*3) are adopted as the displacement causing means, according to a second embodiment shown by FIG. 5, linear motors are adopted as displacement causing means. In the drawing, common notations are attached to constituent portions using members the same as those in the above-described embodiment.

Notations 15*a*1, 15*a*2 and 15*a*3 designate holding frame portions which are fixedly screwed to the base bar 5 and constitute attaching and holding members along with the base bar 5 and the respective holding frame portions 15*a*1, 15*a*2 and 15*a*3 are fixedly screwed to the support member 1 shown by FIG. 4. Further, each of the holding frame portions 15*a*1, 15*a*2 and 15*a*3 is mounted with a mover and a stator of a linear motor.

Notation 16*a*1 designates a mover screwedly coupled to the guide bar 10*a*3 of the upper rank among the guide bars 10*a*1, 10*a*2 and 10*a*3 in three ranks on the front side, via a connecting member 18*a*1. Notation 16*a*2 designates a mover screwedly coupled to the guide bar 10*a*2 of the middle rank via a connecting member 18*a*2 , while notation 16*a*3 designates a mover screwedly coupled to the guide bar 10*a*1 of the lower rank via a connecting member 18*a*3. Further, the movers 16*a*1, 16*a*2 and 16*a*3 are respectively provided with stators 17*a*1, 17*a*2 and 17*a*3 by which the respective movers are integrated movably in the direction of extending the guide bar relative to the respective corresponding stators.

Further, although concealed in the drawing, the guide bars 10*b*1, 10*b*2 and 10*b*3 on the rear side are respectively connected to movers of linear motors via connecting members 18*b*3, 18*b*2 and 18*b*1 and the respective movers are integrated movably in the direction of extending the guide bar relative to the respective corresponding stators.

With respect to a detailed structure of the linear motor comprising the mover and the stator, a well-known technology of a linear motor is utilized and the structure is basically the same as that disclosed in PCT WO95/19462 concerning a patterning device proposed by the applicant and an explanation of the details will be omitted.

Further, in the above-described respective embodiments, the respective guide bars 10*a*1, 10*b*1, 10*a*2, 10*b*2, 10*a*3 and 10*b*3 are transmitted with displacements caused by the servo motors 3*a*1, 3*b*1, 3*a*2, 3*b*2, 3*a*3 and 3*b*3 or the movers 16*a*1, 16*b*1, 16*a*2, 16*b*2, 16*a*3 and 16*b*3 of the linear motors as displacement causing means and desired knitting motion (overlapping, underlapping) is carried out.

The above-described respective embodiments may utilize a displacement function by piezoelectric elements other than the servo motors or the linear motors which are adopted as displacement causing means and combinations of these means may naturally be included in the present invention.

Further, although according to the above-described respective embodiments, the guide bars are movably attached to the base bar as the attaching and holding member in a state where they are addingly brought into contact therewith, a structure in which the guide bars are addingly attached to displacement causing means directly attached to the support member can also be constructed.

Figure 20:
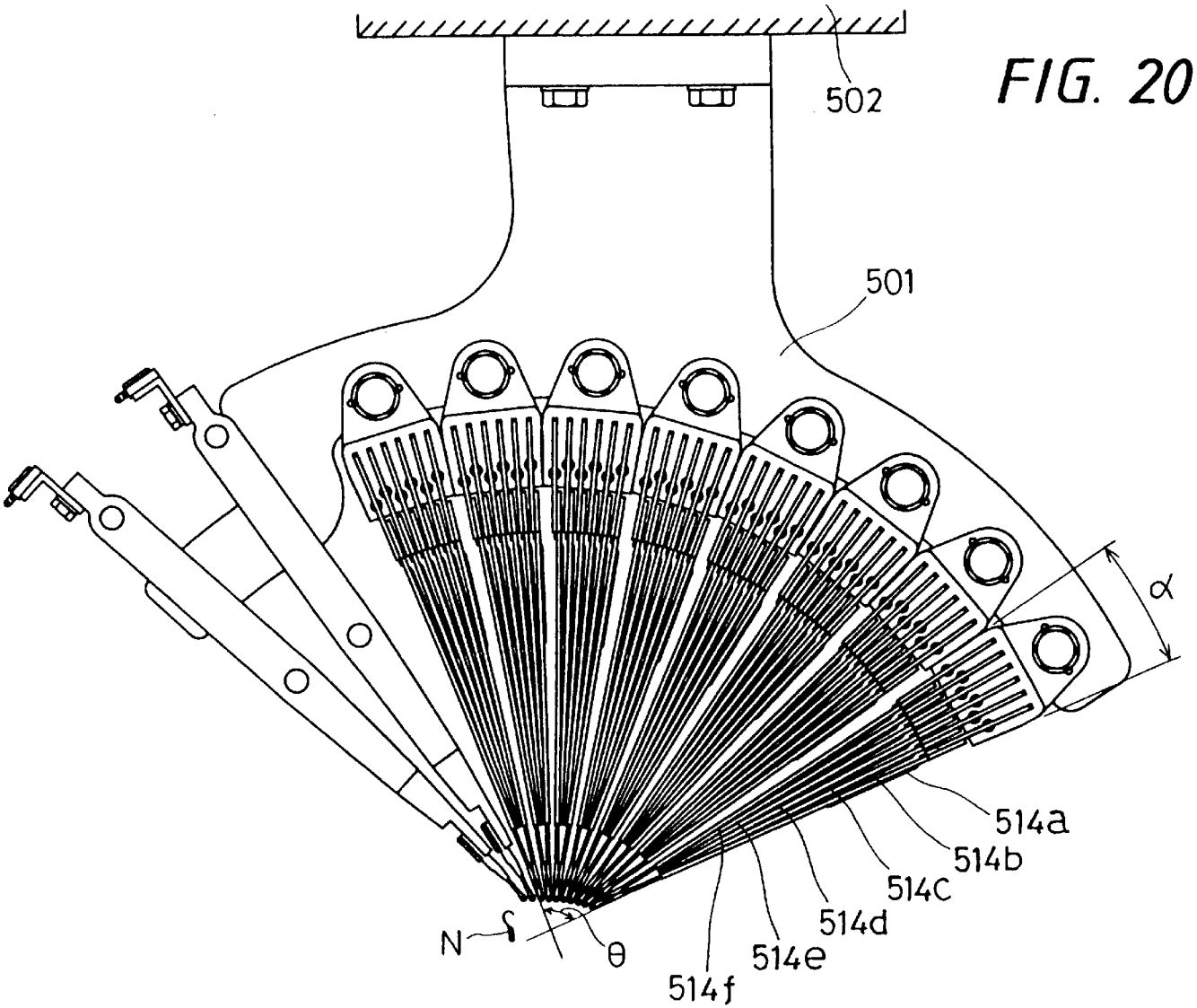
FIG. 20 is a side view showing a nest angle θ constituted by a unit group of guide bars as a conventional guide attaching member and installation angle of circumference a of one guide attaching member unit.

In the above-described respective embodiments, shown in FIG. 1, FIG. 2 or FIG. 5 is one unit of the guide bar group in which six sheets of the guide bars constitute one set, now, when a length L of the guide is set to 180 mm and the unit is compared with a unit of guide bars in the conventional structure, an angle of circumference a of one unit including the guide 514*a* through the guide 514*f* of the conventional structure shown by FIG. 20, is 12° whereas an angle of circumference a1 in FIG. 2 is 8°. Therefore, if the units of the conventional guide bars are set in an angle range (q1=88°) similar with that of eleven rows of the guide bar units shown by FIG. 4, only eight rows of the guide bar units can be arranged and further, the angle θ exceeds 90°.

In this way, according to the guide drive device of the present invention, even in setting a number of units of guide bars the same as in the conventional case, the angle of circumference a for installing one guide bar unit can considerably be reduced. As a result, the number of the guide bars can be increased within the range of the nest angle the same as in the conventional case, while a unit number (nest number) of guide bars can be increased by further increasing the units of guide bars if necessary.

Further, in the technical concept of the present invention, whereas according to the above-described embodiments, the guide bars 10 (10*a*1 through 10*a*3, 10*b*1 through 10*b*3) which are guide attaching members cover a total of a knitting width, this may be partially constituted by individual holding members of a single or a plurality of guides and each of the holding members or each of the guides may have a structure installed with driving means of a linear motor or the like as displacement causing means.

Next, an explanation will be given of an embodiment of a guide drive device according to a second aspect of the present invention in reference to the drawings.

In FIG. 6, FIG. 7, FIG. 8, FIG. 9 and FIG. 10, numeral 100 designates a thread feed guide for patterning and the thread feed guide 100 is constituted by a thread feeding guide needle 101 having a thread lead hole 101*a* at its distal end and a guide supporter 102 for supporting the guide needle 101. The thread feed guide 100 is attachedly coupled to a sliding portion 103 slidably arranged to a guide portion, mentioned later, and this constitutes a guide attaching member.

Numeral 105 designates an attaching and holding member comprising a plate-like member fixed to a machine frame (not illustrated) of a main body of a warp knitting machine by being arranged in parallel with a knitting needle row. Both front and rear faces of the attaching and holding member 105 are respectively recessed with a plurality of rows of guide portions 105*a*, 105*b*, 105*c*, 105*d*, 105*e* and 105*f*. The sliding portions constituting portions of the guide attaching members are slidably fitted to the respective guide portions.

In the means in detail, the sliding portion 103 is constituted by a sliding member 106 on the side of the guide supporter 102 and a sliding member 107 on the side of the attaching and holding member 105, while the sliding members 106 and 107 are slidably fitted to the guide portion 105*a* at a first rank from below on one face of the attaching and holding member 105. The thread feed guide 100 is attachedly screwed to the sliding member 107 via the projected portion 106*a*, by a countersunk head screw 108 inserted through a through hole 106*b* at the central portion of a projected portion 106*a* of the sliding member 106. By a leaf spring 115 arranged at a gap 104 between the sliding member 106 and the sliding member 107, the two sliding members 106 and 107 are pushed in an arrow mark B direction to widen the gap elastically, and are slidably brought into close contact with the attaching and holding member 105. Further, in order to prevent lateral deflection of the thread feed guide 100 in attaching the guide, positioning pins 109*a* and 109*b* are fitted to holes bored in the guide supporter 102 and holes bored in the projected portion 106*a* of the sliding member 106.

Figure 11:
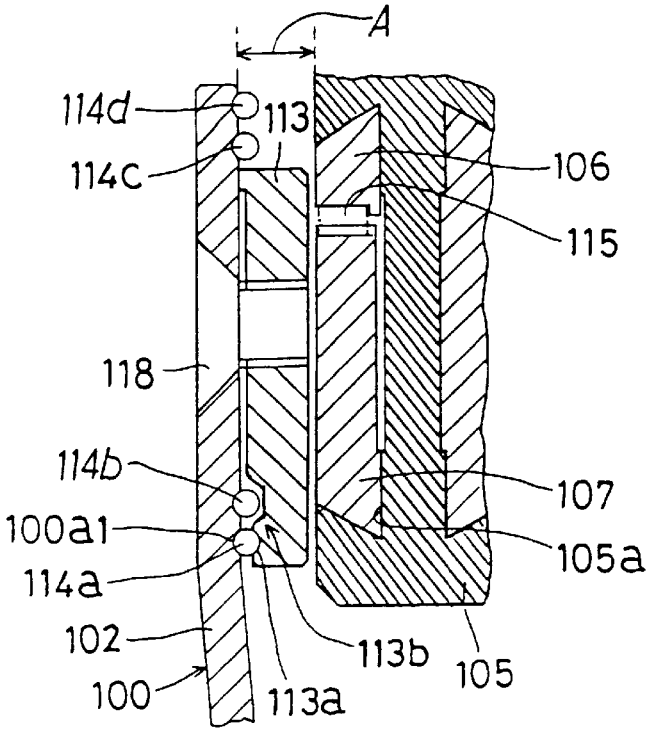
FIG. 11 is a sectional view taken along a line Y-Y of FIG. 8 showing the sliding portion and its peripheral members of the guide attaching member in the guide drive device.

According to showing in FIG. 11, a clamp plate 113 is inserted into a gap A between the sliding member 107 and the guide supporter 102 which is maintained by screwing the thread feed guide 100. The clamp plate 113 is fixedly fastened to the guide supporter 102 by a countersunk head screw 118.

Notation 114*a* designates a wire as an example of a driving long member that is connected to displacement causing means of a motor or the like, and is hung in the longitudinal direction of the attaching and holding member 105. The wire 114*a* is held by a wire receiving recess portion 113*a* of the clamp plate 113 and a wire receiving recess portion 100*a*1 of the guide supporter 102. The wire 114*a* is tightly fastened by being brought into press contact with the thread feed guide 100 by fastening the countersunk head screw 118. Thereby, drive force of displacement causing means is transmitted to the thread feed guide 100 via the wire 114*a*, and predetermined shogging motion is carried out. A wire 114*b* mentioned above is arranged in a groove portion 113*b* of the clamp plate 113 such that it is not brought into contact with the clamp plate 113.

Figure 6:
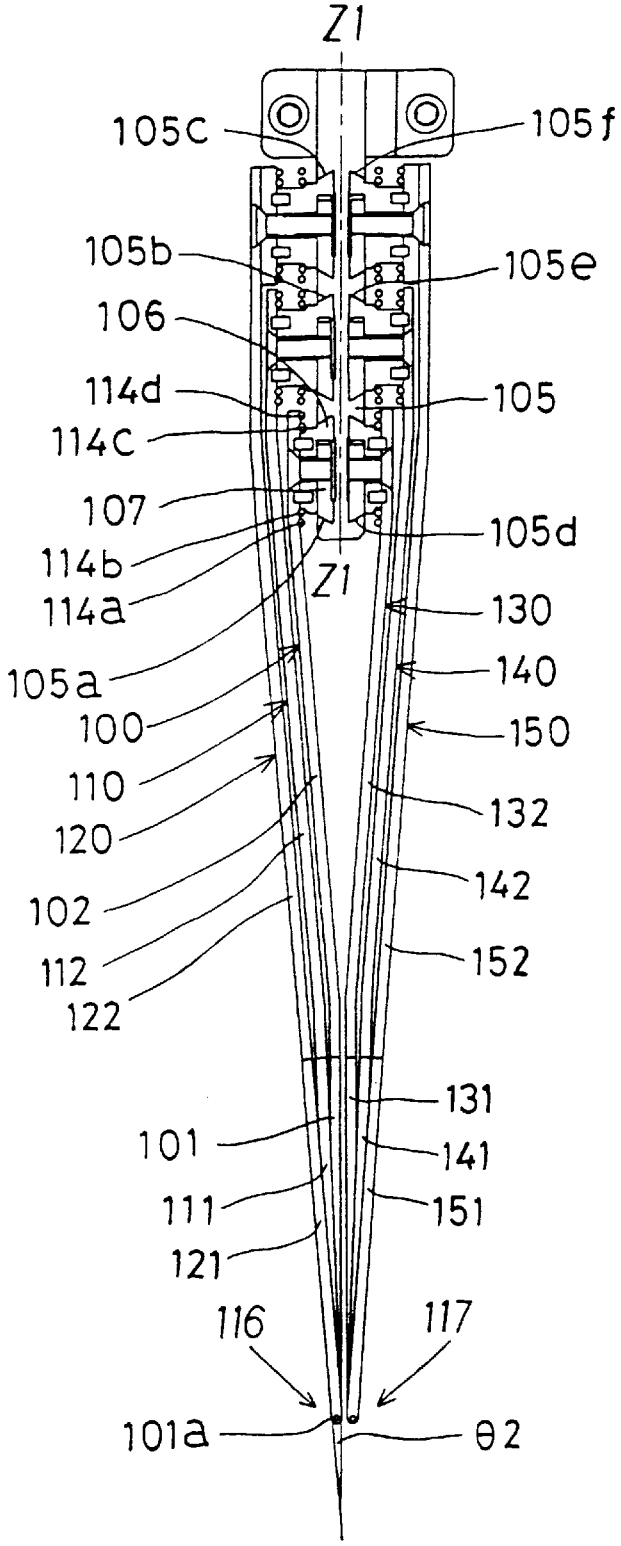
FIG. 6 is a side view showing a partially-cut face orthogonal to the longitudinal direction of the warp knitting machine in the first embodiment of the guide drive device according to a second aspect of the present invention.
Figure 7:
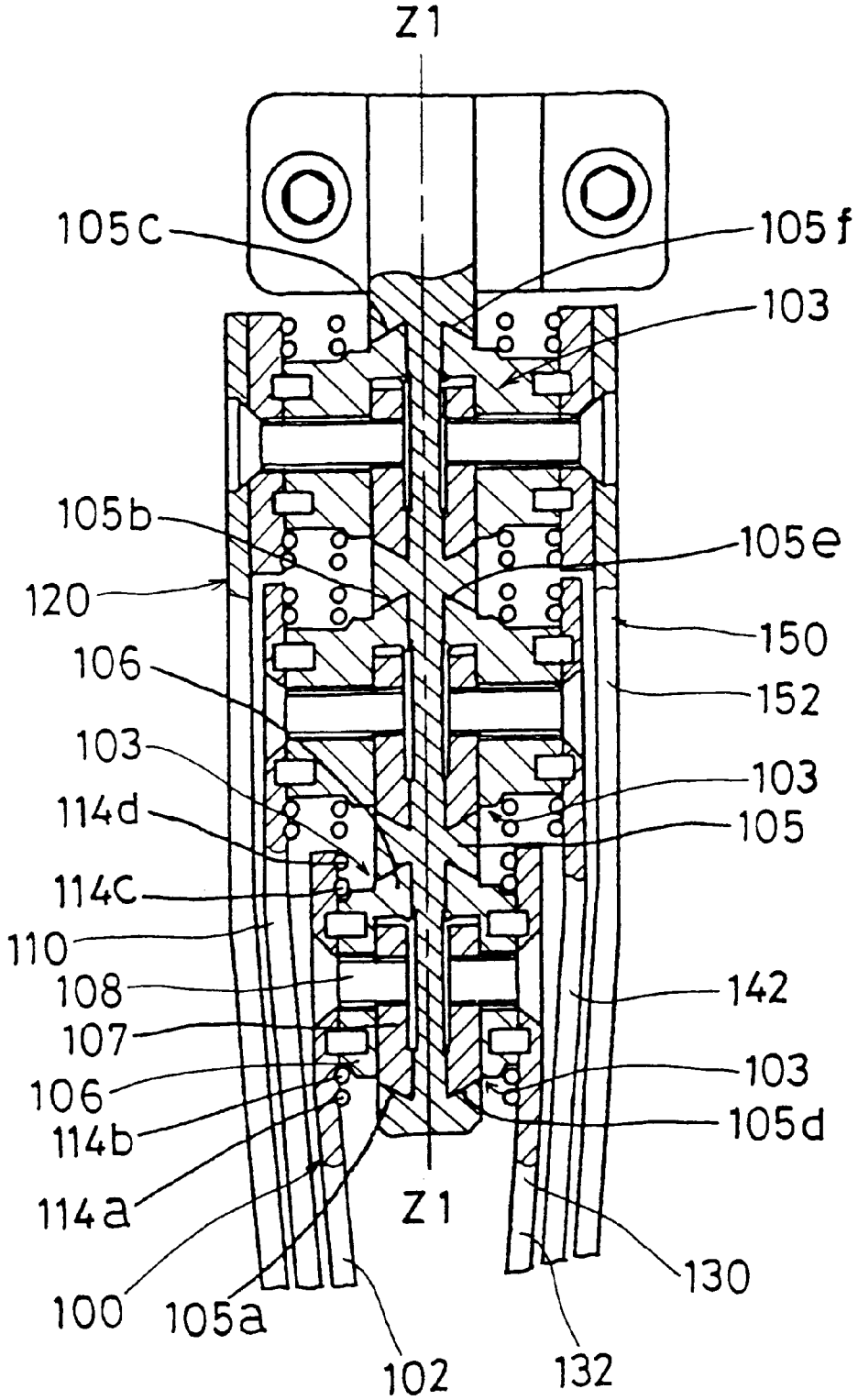
FIG. 7 is a view enlarging a section of a portion of the former drawing.

As shown by FIG. 6 and FIG. 7, a nest 116 is constituted on one side of the attaching and holding member 105 by three rows of guide rows in which thread lead holes at distal ends of guide needles are aligned in one row. In this nest 116, a thread feed guide 110 disposed outer than the thread feed guide 100 is arranged as deviated or shifted in the front or rear direction of the warp knitting machine, such that even when the thread feed guides are made adjacent to each other by carrying out shogging motion in the longitudinal direction of the attaching and holding member 105, the guide supporter 112 is not brought into contact with the guide supporter 102. Similar to the thread feed guide 100, the thread feed guide 110 is screwed to a sliding member in contact with the side of the attaching and holding member 105 in the sliding portion and the sliding member is slidably fitted to a guide portion 105*b* above the guide portion 105*a*.

Further, at the outer side of the thread feed guide 110, the thread feed guide 120 is arranged as deviated in the front or rear direction of the warp knitting machine such that a guide supporter 122 is not brought into contact with the guide supporter 112 of the thread feed guide 110. Similar to the thread feed guide 100, the thread feed guide 120 is screwed to a sliding member in contact with the side of the guide portion 105*c* of the attaching and guiding member 105 and the sliding member is slidably fitted to the guide portion 105*c* on the upper side of the guide portion 105*b*.

Numerals 101, 111 and 121 respectively designate guide needles of the thread feed guides 100, 110 and 120 and as mentioned above. The thread feed guides 100, 110 and 120 are arranged as deviated from each other in the front and rear direction of the warp knitting machine such that even when they become adjacent to each other by shogging motion, the respective guide supporters 102, 112 and 122 are not brought into contact with each other. Accordingly, the guide needles 101, 111 and 121 can be made adjacent to each other up to immediately before they are brought into contact with each other as shown by FIG. 8.

Figure 8:
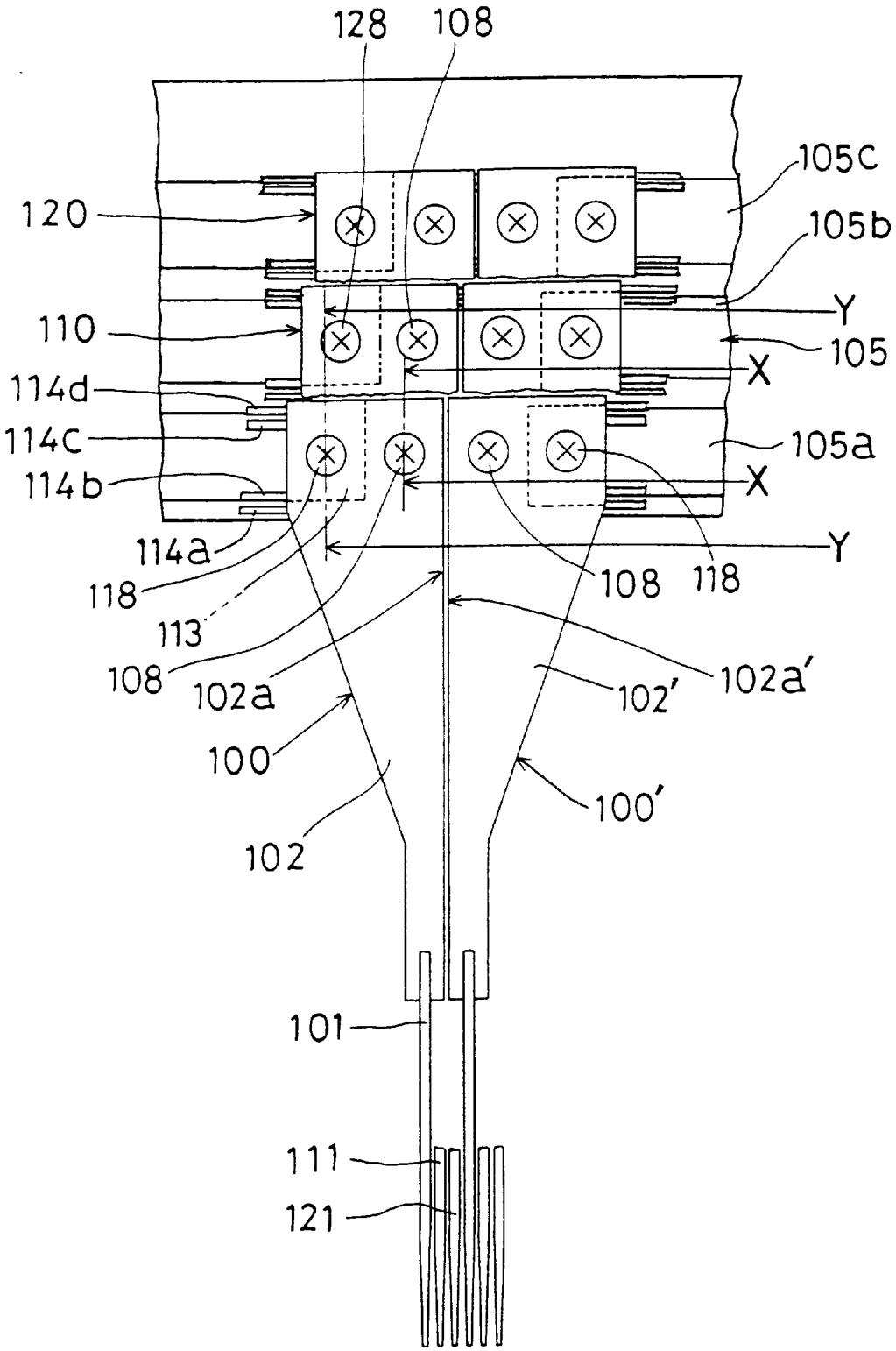
FIG. 8 is a front view showing the guide drive device of FIG. 6 installed to the warp knitting machine by partially cutting it.
Figure 9:
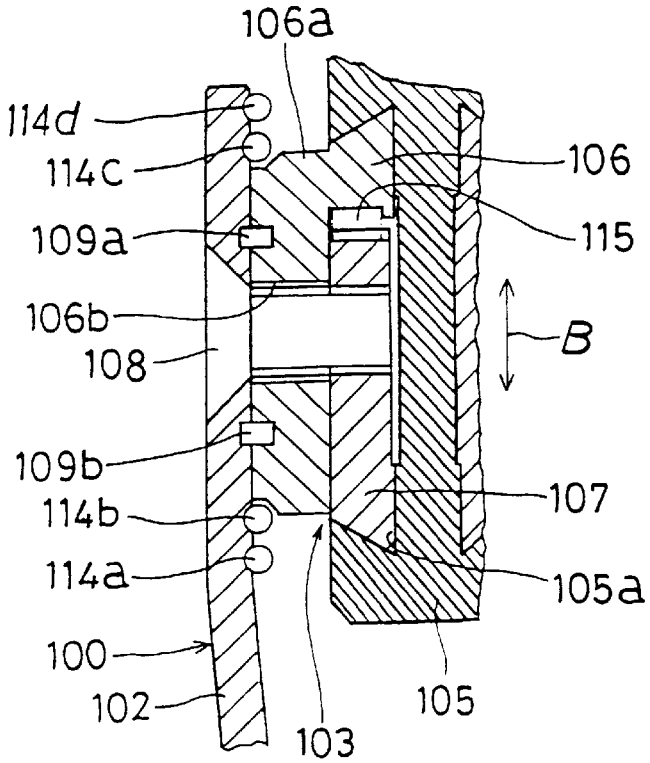
FIG. 9 is a sectional view taken from a line X-X of FIG. 8 showing a sliding portion and its peripheral members of a guide attaching member in the guide drive device.
Figure 10:
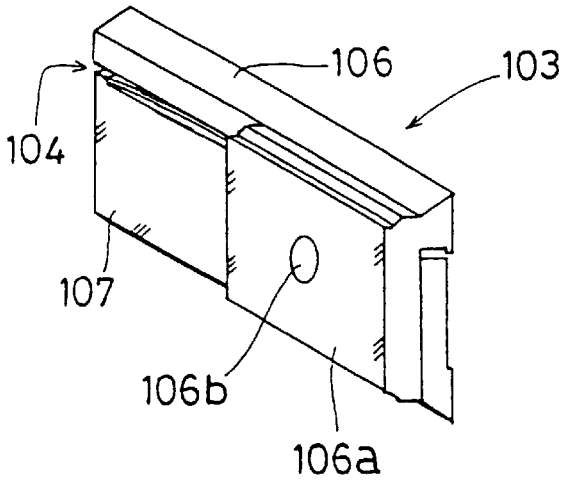
FIG. 10 is an outline perspective view of the sliding portion of the guide attaching member.

Further, as shown by FIG. 8, in the same guide portion 105*a*, the thread feed guide 100 and a thread feed guide 100' are arranged as follows. The thread feed guide 100 is formed such that a longitudinal edge 102*a* of the guide supporter 102 is orthogonal to the longitudinal direction of the attaching and holding member 105. The thread feed guide 100' is formed such that a longitudinal edge 102*a'* of a guide supporter 102' is orthogonal to the longitudinal direction of the attaching and holding member 105. The edge 102*a* and the edge 102*a'* are opposed to each other.

By this arrangement, both of the thread feed guides 100 and 100' are not brought into contact with each other if distance of about three needles is designed to be kept therebetween even when they are made adjacent to each other by shogging motion in the longitudinal direction of the attaching and holding member 105. In this way, a plurality of thread feed guides can be arranged to each and same one of the guide portions 105*a,* 105*b* and 105*c* such that they are not brought into contact with each other.

Further, a space capable of arranging the wires is widened in the front and rear direction of the warp knitting machine by an amount of the deviation in the front and rear direction. Accordingly, in respect of a number of wires designated by small circles in FIG. 1, wires which can drive the thread feed guide 100 are four of the wires 114*a,* 114*b,* 114*c* and 114*d,* whereas wires capable of driving the thread feed guide 110 are eight wires respectively.

Further, a nest 117 constituted by three rows of guide rows is provided symmetrically to the nest 116 in respect of a center line Z1-Z1 of the attaching and holding member 105. Similar to the above-described thread feed guide 100, thread feed guides 130, 140 and 150 arranged in the nest 117 are respectively coupled to sliding portions that are respectively fittedly arranged to the guide portions 105*d,* 105*e* and 105*f* installed opposedly to and symmetrically with the guide portions 105*a,* 105*b* and 105*c* in the attaching and holding member 105 respectively. These constitute the guide attaching members.

The respective sliding members are attachedly screwed with the thread feed guides 130, 140 and 150, and are slidably fitted to the respective guide portions 105*d,* 105*e* and 105*f*. The thread feed guide 140 disposed outer than the thread feed guide 130 are arranged as deviated from the thread feed guide 130, the thread feed guide 150 on the outer side of the thread feed guide 140 is arranged as deviated from the thread feed guide 140. The deviation is made successively in the front and rear direction of the warp knitting machine such that even when the thread feed guides are made adjacent to each other by shogging motion in the longitudinal direction of the attaching and holding member 105, respective guide supporters 132, 142 and 152 are not brought into contact with each other.

The thread feed guides 130, 140 and 150 are also arranged as deviated from each other such that even when they are made adjacent to each other by shogging motion, the respective guide supporters 132, 142 and 152 are not brought into contact with each other. Accordingly, guide needles 131, 141 and 151 can be made adjacent to each other up to immediately before they are brought into contact with each other.

Further, similar to the nest 116, a number of wires capable of driving the thread feed guide 130 is four and numbers of wires capable of driving the thread feed guides 140 and 150 are respectively eight.

FIG. 12 through FIG. 16 respectively show other examples of states in which thread feed guides and wires constituting driving long members are tightly fastened.

Figure 12:
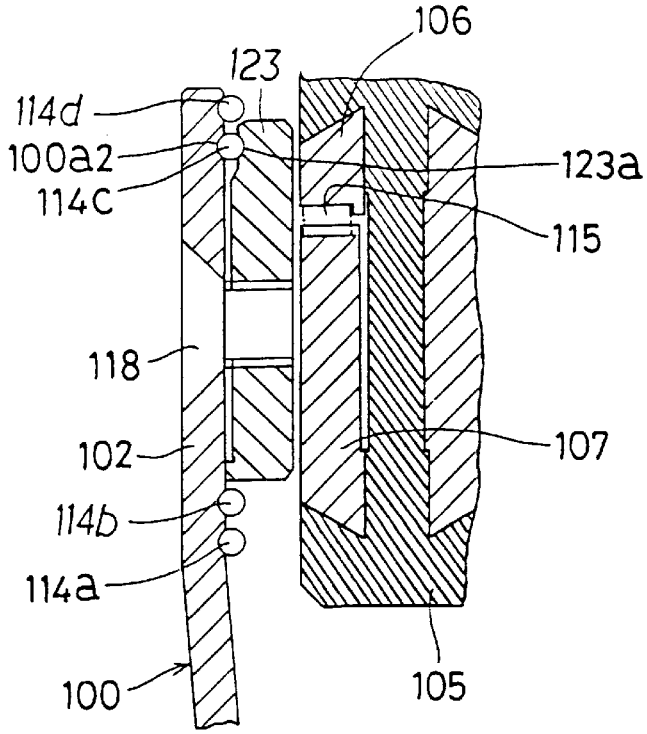
FIG. 12 is a sectional view of a sliding portion and peripheral members thereof in a sectional state similar to that of FIG. 11 showing other example of the first embodiment of the guide drive device in which the thread feed guide and a long member for driving are tightly fastened.

FIG. 12 shows a case in which the wire 114*c* is tightly fastened to the thread feed guide 100 and is capable of driving to displace the thread feed guide 100. In this case, the wire 114*c* is held between the wire receiving recess portion 123*a* of a clamp plate 123 and a wire receiving recess portion 100*a*2 of the thread feed guide and is tightly fastened to the thread feed guide 100 by fastening the countersunk head screw 108.

Figure 13:
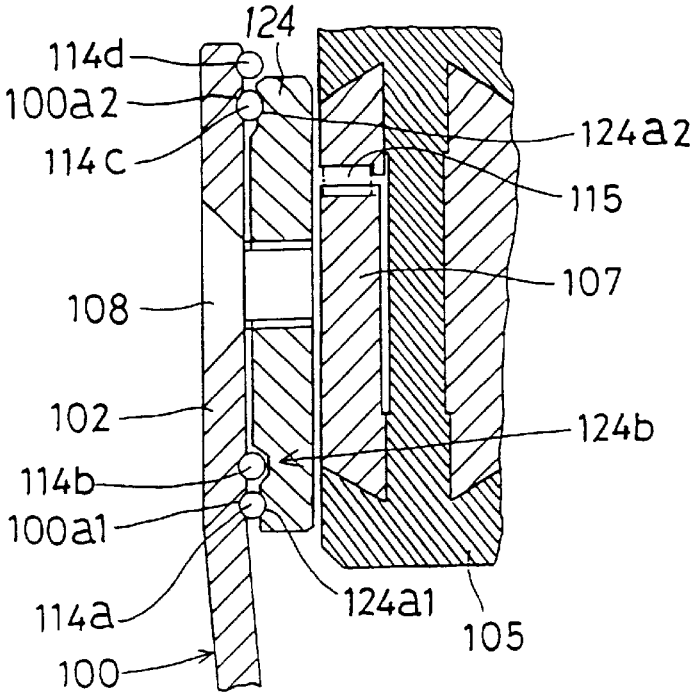
FIG. 13 is a sectional view exemplifying a state of tightly fastening other thread feed guide and the long member for driving.

FIG. 13 shows a case in which the upper and lower two wires 114*a* and 114*c* are simultaneously and tightly fastened to the thread feed guide 100 to stabilize displacement motion of the thread feed guide 100 in shogging motion of the thread feed guide 100 in the longitudinal direction of the attaching and holding member 105. That is, the wires 114*a* and 114*c* are held by respective wire receiving recess portions 124*a*1 and 124*a*2 of a clamp plate 124 and the respective wire receiving recess portions 100*a*1 and 100*a*2 on the side of the thread feed guide, and are tightly fastened to the thread feed guide 100 by fastening the countersunk head screw 108. Further, the wire 114*b* is arranged in a groove 124*b* on the clamp plate 124 such that it is not brought into contact with the clamp plate 124.

Figure 14:
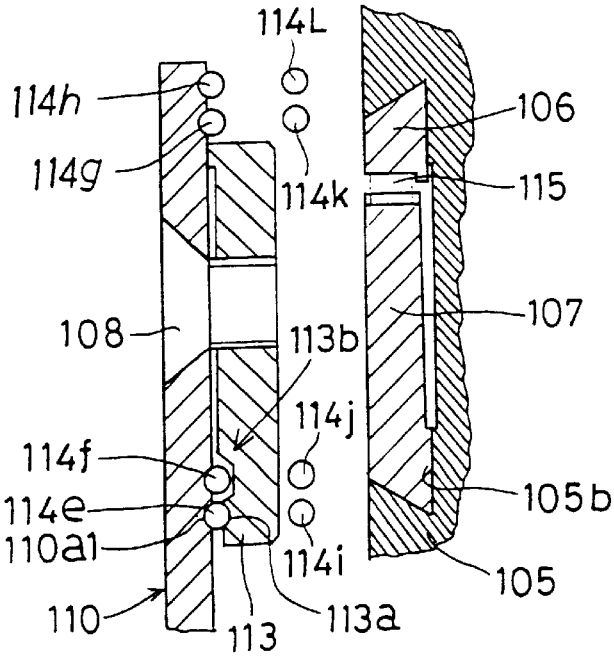
FIG. 14 is a sectional view exemplifying a state of tightly fastening still other thread feed guide and the long member for driving.

FIG. 14 shows a case in which a wire 114*e* is fastened to the thread feed guide 110 among wires 114*e,* 114*f,* 114*g,* 114*h,* 114*i,* 114*j,* 114*k* and 114L capable of driving the thread feed guide 110 held by the guide portion 105*b*. Similar to tightly fastening the wire 114*c* in FIG. 11, the wire 114*e* is held by the wire receiving recess portion 113*a* of the clamp plate 113 and the wire receiving recess portion 110*a*1 on the side of the thread feed guide and is tightly fastened to the thread feed guide 110 by tightening the countersunk head screw 108. Further, the wire 114*f* is arranged in the groove portion 113*b* of the clamp plate 113 such that it is not brought into contact with the clamp plate 113.

Figure 15:
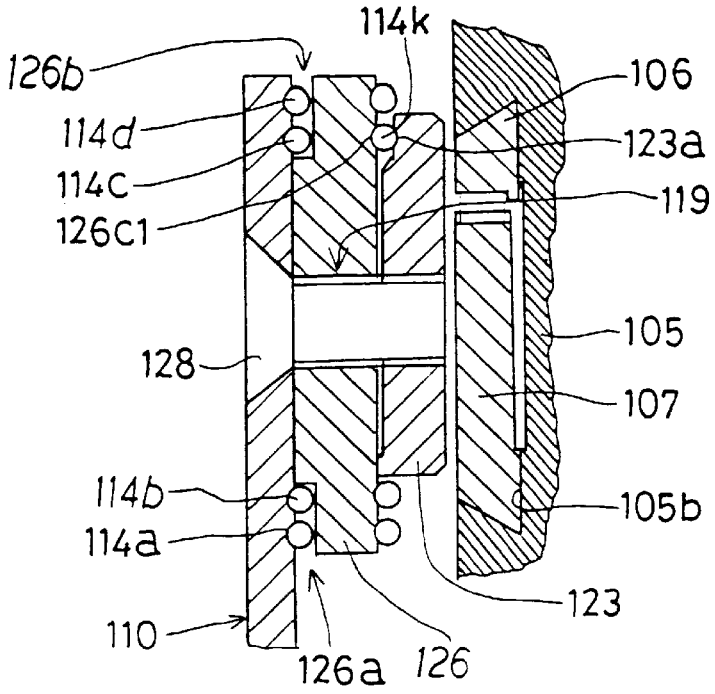
FIG. 15 is a sectional view exemplifying a state of tightly fastening still other thread feed guide and the long member for driving.

FIG. 15 shows a state where the wire 114*k* is tightly fastened to the thread feed guide 110. Similar to the case of tightly fastening the wire 114*c* in FIG. 12, a spacer 126 is constituted by interposing a wire 114*c* between the clamp plate 123 and the thread feed guide 110. The spacer 126 is installed with notch portions 126*a* and 126*b* such that the spacer 126 is not brought into contact with the wires 114*a,* 114*b,* 114*c* and 114*d,* and such that a reamer hole 119 penetrated through a vicinity of the central portion is inserted with a countersunk head screw 128 in a state of no play when the countersunk head screw 128 is fastened. The wire 114*k* is held by the wire receiving recess portion 123*a* of the clamp plate 123 and a wire receiving recess portion 126*c*1 on the side of the spacer and is brought into press contact with the thread feed guide 110 via the spacer 126 by fastening the countersunk head screw 128 and is held in a tightly fastened state.

Figure 16:
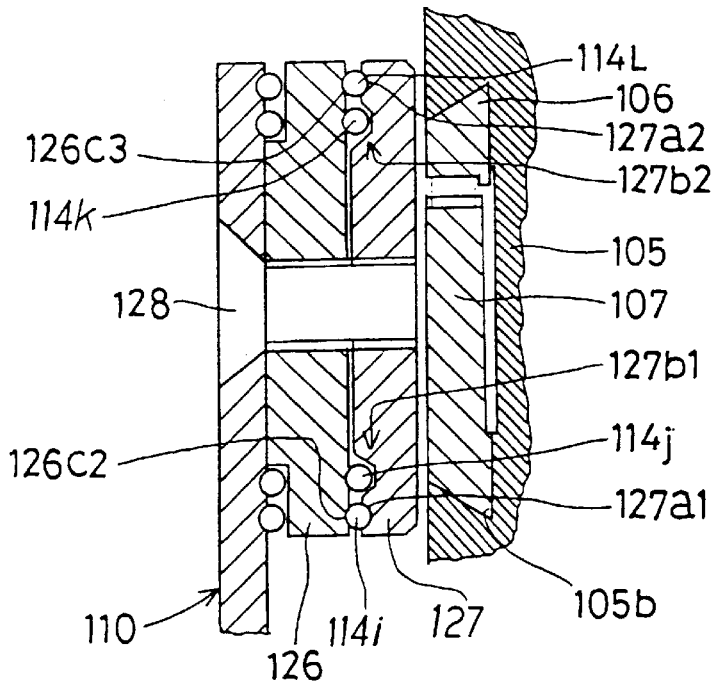
FIG. 16 is a sectional view exemplifying a state of tightly fastening still other thread feed guide and the long member for driving.

FIG. 16 shows a tightly fastened state in which the wires 114*i* and 114L are simultaneously and tightly fastened to stabilize motion of the thread feed guide 110 in shogging motion of the thread feed guide 110 in the longitudinal direction of the attaching and holding member 105. The wires 114*i* and 114L are held by respective wire receiving recess portions 127*a*1 and 127*a*2 of a clamp plate 127 and respective wire receiving recess portions 126*c*2 and 126*c*3 on the side of the spacer. The wires 114*i* and 114L are tightly fastened to the thread feed guide 110, via the spacer 126, by fastening the countersunk head screw 128. Further, the wires 114*j* and 114*k* are arranged in groove portions 127*b*1 and 127*b*2 of the clamp plate 127 such that each of them are not brought into contact with the clamp plate 127.

As has been described, according to the guide drive device of the embodiment, by symmetrically arranging the nest 116 and the nest 117 to a single one of the attaching and holding member 105, a portion of a space at a vicinity of a reed allocated for the guide portion is smaller than that in the case where a single one of an attaching and holding member is used for one set of a nest. Accordingly, although not illustrated, 20 sets of nest group of thread feed guides are arranged in a warp knitting machine. Further, a number of wires arranged in one group nest is 20 and each of them can carry out independent shogging motion. Accordingly, the patterning function of the warp knitting machine arranged with a nest group of 20 sets of thread feed guides mentioned above significantly surpasses that of a kind of a Multibar Raschel machine in which the nest number is simply increased.

As shown by FIG. 8, when the thread feed guide 100 is tightly fastened to at least one wire of the wires 114*a*, 114*b*, 114*c* and 114*d* and the thread feed guide 100' is tightly fastened to a wire other than the wire tightly fastening the thread feed guide 100, drive displacements from patterning driving means (not illustrated) are transmitted to two of the thread feed guides 100 and 100' arranged in the same guide portion 105*a* as respective independent shogging motions in the longitudinal direction of the attaching and holding member 105, via the wires which are driving long members tightly fastened to the respective thread feed guides.

As shown by FIG. 6, the thread feed guides 100, 110 and 120 in the nest 116, are arranged as deviated from each other in the front and rear direction of the warp knitting machine such that even when they are made adjacent to each other by carrying out shogging motion in the longitudinal direction of the attaching and holding member 105, the respective guide supporters 102, 112 and 122 are not brought into contact with each other. Therefore, compared with a nest of a Multibar Raschel machine, when the nest 116 is viewed from the side face of the warp knitting machine, a number of guide needle rows is small and intervals for avoiding contact between the guide supporters need not to be provided among the thread feed guide rows. Therefore, a nest angle θ2 of the nest 116 is smaller than a nest angle of a nest by guide needles of thread feed guides attached to a pattern reed of a Multibar Raschel machine.

Further, the nest 116 and the nest 117 are symmetrically arranged in respect of the center line Z1-Z1 of the one attaching and holding member 105. Accordingly, a portion of a space at a vicinity of a reed allocated for the guide member is smaller than that in the case in which a single one of an attaching and holding member corresponds with a single one of a nest. Although not illustrated, 20 sets of nest group of the thread feed guides is arranged in a warp knitting machine. Further, a number of wires arranged in one group of the nest is 20 and respectives thereof can carry out independent shogging motion and therefore, the patterning function of a warp knitting machine arranged with the 20 sets of nest group of the thread feed guides surpasses that of a kind of a Multibar Raschel machine in which only the nest number is increased.

As shown by FIG. 9 and FIG. 11 through FIG. 16, by overturning the clamp plate upside down which is tightly fastening the thread feed guide 100 or the thread feed guide 110 and any of wires, or by interchanging the clamp plate, the thread feed guide 100 can freely be attached to or detached from at least one of the wires 114*a*, 114*b*, 114*c* and 114*d* and the thread feed guide 110 can freely be attached to or detached from at least one of the wires 114*e*, 114*f*, 114*g*, 114*h*, 114*i*, 114*j*, 114*k* and 114L.

As shown by FIG. 6 through FIG. 8, by constituting driving long members connected to driving means by the slender wires, when the respective wires tightly fastening the thread feed guides 100 and 100' arranged in the same guide portion 105*a* are transmitted with drive displacements from driving means (not illustrated), the wires do not rub on peripheral members. Because 20 of the wires are arranged in the nest 116, a number of independent shogging motions arranged in the one group nest is 20 which is much larger than that of a Multibar Raschel machine. Therefore, in producing slender width lace fabric, different patterns can simultaneously be knitted at respective pattern repeat widths of, for example, about 12 kinds or 20 kinds.

For example, in the case of producing slender width lace fabric of 8 inch width having a pattern as fine as or finer than that of 6 inch width, when a maximum underlapping width of thread feed guide for patterning is distributed to respective thread feed guides in one repeat width of pattern at the time of designing pattern, even if only two thread feed guides are attached to different driving long members of one row of guide portions, it can be distributed to 120 of thread feed guides within one repeat width of pattern (2 thread feed guides×3 rows×20 nests=120).

Further, also in the case of knitting wide width lace fabric, when a maximum underlapping width of thread feed guide for patterning is distributed to respective thread feed guides in one repeat width of pattern at the time of designing pattern similar to the above-described, even in the case where only 4 of thread feed guides are attached to one row of different driving long members, it can be distributed to 240 of thread feed guides in one repeat width of pattern (4 thread feed guides×3 rows×20 nests=240).

Even in the case of producing lace fabric capable of sufficiently competing with lace fabric produced by a Multibar Raschel machine of a conventional system, by using several nests on the front side of the warp knitting machine among a total of nests of thread feed guides, thread feed guides need not to attach to the nests on the rear side of the warp knitting machine, and using of only nests on the front side of the warp knitting machine is enough which are not so much inclined to the horizontal direction.

Next, an explanation will be given of a second embodiment according to the second aspect of the present invention.

Figure 17:
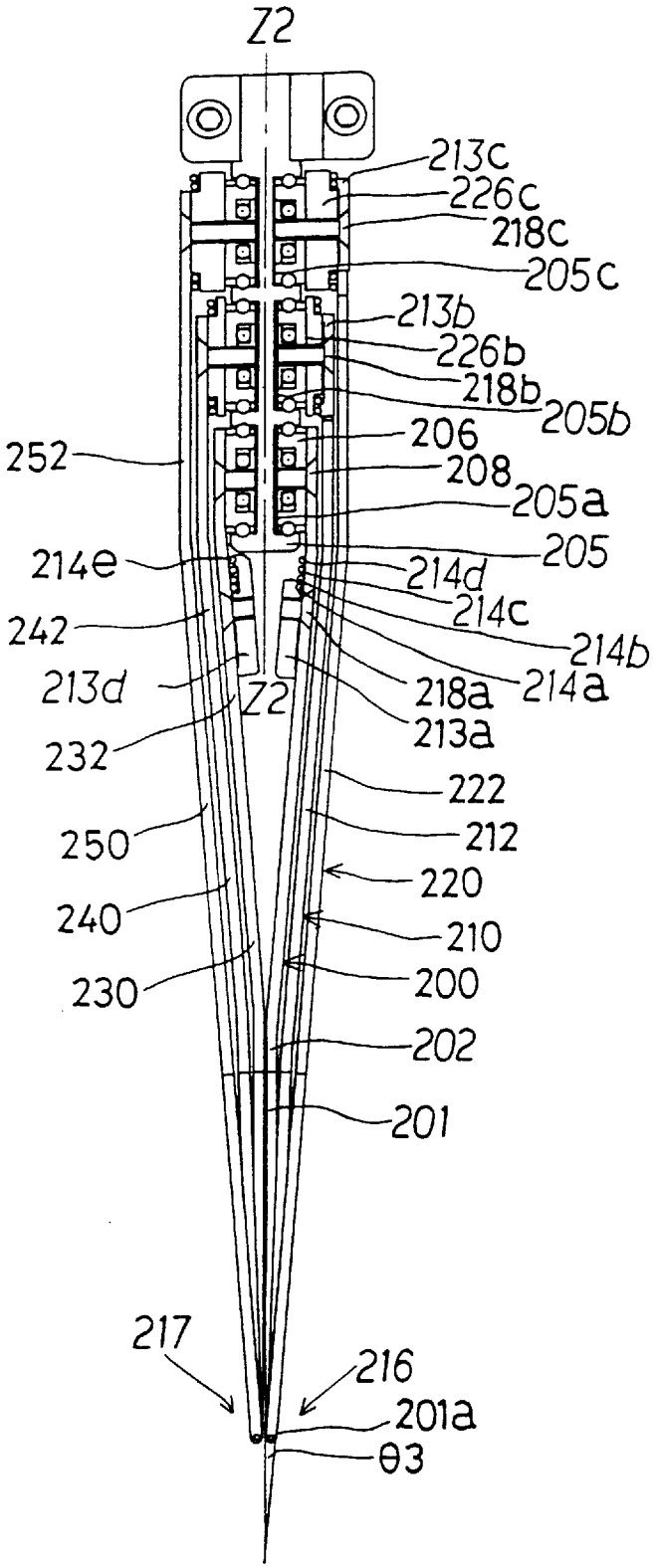
FIG. 17 is a side view showing a second embodiment of a guide drive device in a warp knitting machine according to a second aspect of the present invention by partially cutting a face thereof orthogonal to the longitudinal direction of the warp knitting machine.
Figure 18:
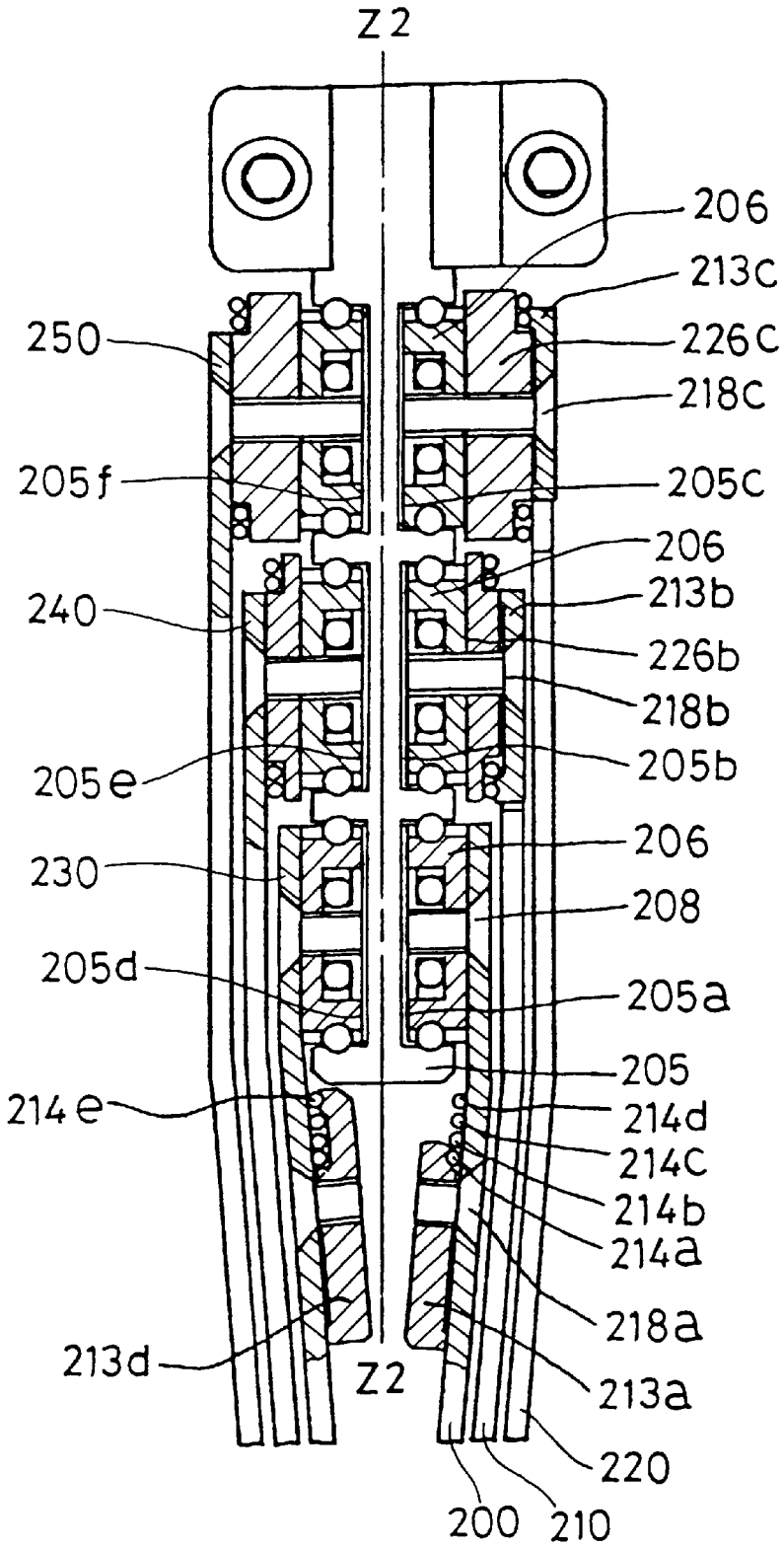
FIG. 18 is a view enlarging a section of a portion of the former drawing.

In FIG. 17 and FIG. 18, numeral 200 designates a thread feed guide and the thread feed guide 200 is constituted by a guide needle 201 having a thread lead hole 201*a* at its distal end and a guide supporter 202 fixedly attached with the guide needle 201. Notation 205*a* designates a guide portion recessed to the side face of an attaching and holding member 205 fixed to a main body of a warp knitting machine (not illustrated) and a ball bearing 206 constituting a sliding portion is slidably fitted to the guide portion 205*a*. Further, the thread feed guide 200 is screwedly coupled to the ball bearing 206 by a countersunk head screw 208 and this constitutes a guide attaching member.

A clamp plate 213*a* is fastened to the guide supporter 202 by a countersunk head screw 218*a*, a wire 214*a* constituting a driving long member hung in the longitudinal direction of the attaching and holding member 205, is interposed between the clamp plate 213*a* and the thread feed guide 200 and is tightly fastened to the thread feed guide 200 by fastening the countersunk head screw 218*a* and wires 214*b*, 214*c* and 214*d* are arranged such that they are not brought into contact with the clamp plate 213*a*.

Other rows of thread feed guides 210 and 220 arranged in a nest 216 constituted by three rows of thread feed guide rows, are respectively provided with clamp plates 213*b* and 213*c* in respective thread feed guide rows at portions of guide supporters 212 and 222 and screwedly coupled to the ball bearings 206 via spacers 226*b* and 226*c* by countersunk head screws 218*b* and 218*c*. The ball bearings screwedly attached to the thread feed guides 200, 210 and 220, are slidably fitted respectively to guide portions 205*a*, 205*b* and 205*c*.

Further, the thread feed guide 210 disposed outer than the thread feed guide 200 is arranged as deviated from the thread feed guide 200 in the front and rear direction of the warp knitting machine while the thread feed guide 220 disposed outer than the thread feed guide 210 is arranged as deviated from the thread feed guide 210, such that even when the thread feed guides are made adjacent to each other by shogging motion in the longitudinal direction of the attaching and holding member 205, the respective guide supporters 202, 212 and 222 are not brought into contact with each other. Small circles in the drawings designate wires, while numbers of wires capable of driving the thread feed guides 200, 210 and 220 are respectively 4 and totaled to 12.

A nest 217 constituted by three rows of thread feed guide rows similar to the above-described, is provided symmetrically with the nest 216 in respect of a center line Z2-Z2 of the attaching and holding member 205. Also in the case, similar to the above-described, respective thread feed guides 230, 240 and 250 are screwedly coupled to the ball bearings 206 arranged at guide portions 205*d*, 205*e* and 205*f* installed to the attaching and holding member 205. However, in order to tightly fasten the wire 214*e*, a clamp plate 213*d* is provided with a shape different from that of the clamp plate 213*a* for tightly fastening the wire 214*a* and other clamp plates are not illustrated in order to show states of screwing the thread feed guides with the ball bearings at other than portions where the clamp plates are present. Further, similar to the nest 216, a number of wires capable of driving the thread feed guides of the nest 217 are totaled to 12.

According to the guide drive device of the embodiment, the thread feed guide 200 is tightly fastened to at least one wire of the wires 214*a*, 214*b*, 214*c* and 214*d* and when other thread feed guide (not illustrated) arranged in the same guide portion 205*a* is tightly fastened to a wire other than the wire for tightly fastening the thread feed guide 200, drive displacements from driving means (not illustrated) are transmitted to the both thread feed guides as respectively independent shogging motion in the longitudinal direction of the attaching and holding member 205.

Even when the thread feed guides 200, 210 and 220 are made adjacent to each other by respective shogging motions, the respective guide supporters 202, 212 and 220 are arranged as deviated from each other such that they are not brought into contact with each other and therefore, similar to the case of the first embodiment, a nest angle θ3 of the nest 216 becomes smaller than a nest angle made by pattern guide needles of pattern guides of a Multibar Raschel machine.

Figure 19:
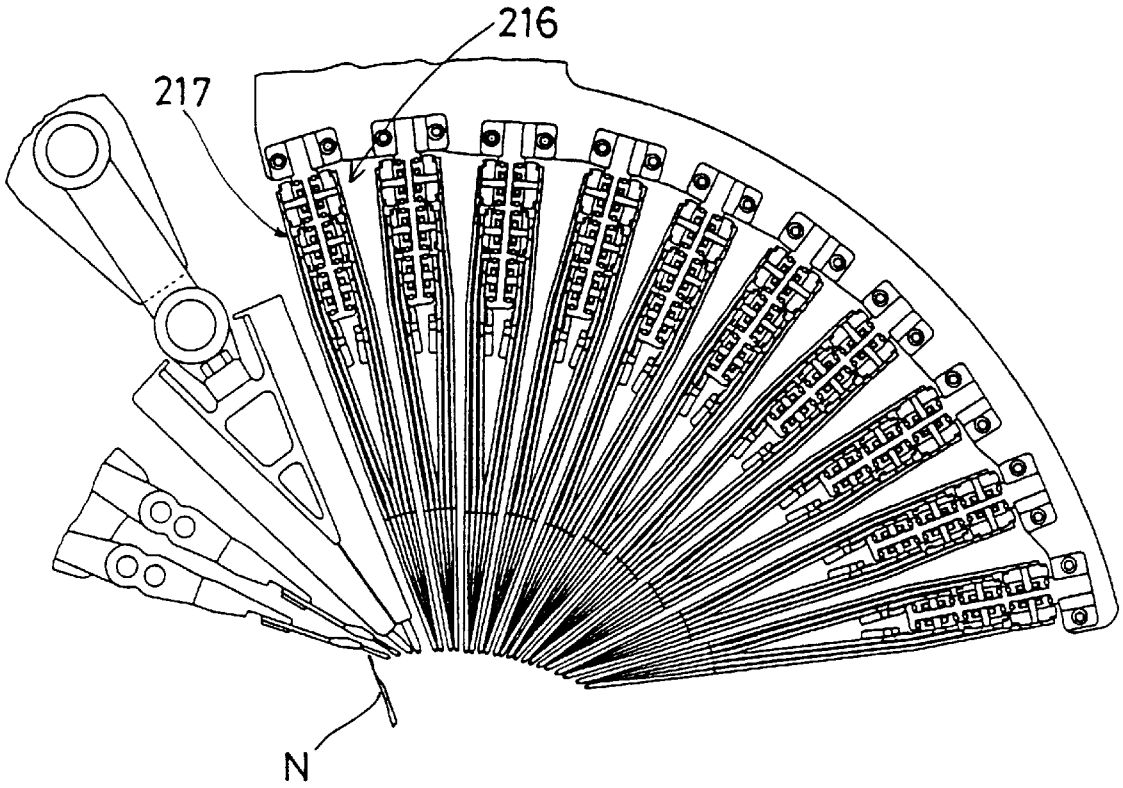
FIG. 19 is a side view showing a knitting region of a warp knitting machine arranged with the guide drive device of FIG. 17 by partially cutting it.

The nest 217 is arranged to be symmetrical with the nest 216 in respect of the center line Z2-Z2 of the attaching and holding member 205 and therefore, a portion of a space at a vicinity of a reed allocated to the guide member is small and accordingly, as shown by FIG. 19, a nest group of 20 sets of thread feed guides is arranged at a warp knitting machine.

Further, a number of wires are arranged to the nest 216 and the nest 217 shown by FIG. 19 is respectively 12 and the respective wires can carry out independent shogging motions and accordingly, the patterning function of the warp knitting machine having the knitting region of FIG. 19 surpasses a kind of a machine in which only the nest number is increased as in a Multibar Raschel machine with the same angle range.

As shown by FIG. 17, the thread feed guide 200 is attached to or detached from at least one of the wires 214*a*, 214*b*, 214*c* and 214*d* by interchanging the clamp plate 213*a*.

By constituting the driving long member of the thread feed guide by a slender wire, the wire does not rub on peripheral members in shogging motion. And, twelve of the wires are arranged in the nest 216. Accordingly, a number of independent shogging motions arranged in one group nest is 12 which is much larger than that of a Multibar Raschel machine.

INDUSTRIAL APPLICABILITY

As has been described, according to the guide drive device of the first aspect of the present invention, the angle of circumference for installing one unit of guide bars constituting guide attaching members is reduced, a number of mounting the guide bars can be increased within the same nest angle, displacement causing means of the individual guide bars, for example, servo motors can be mounted by utilizing an effective space on the upper side of the guide bars and accordingly, there can be provided a warp knitting machine capable of knitting a lace pattern having a complicated and large-sized pattern and capable of saving a mounting area.

Further, according to the guide drive device of the second aspect of the present invention, the nest number can be increased more than that of a Multibar Raschel machine based on a conventional reed structure and accordingly, a number of pattern thread feed guides capable of intersecting in shogging motion is increased. Further, drive displacement by driving means for pattering is connected to the thread feed guide via a driving long member and accordingly, the problem of heat generation at a surrounding of the guide causing mislapping can be resolved.

Particularly, driving long members for a number of thread feed guides can be arranged in one group of a nest, respectives of the thread feed guides tightly fastened thereto can be made to carry out shogging operation independently from each other and accordingly, when slender width lace fabric is produced, different patterns can simultaneously be knitted at each pattern repeat width of, for example, about 12 kinds or 20 kinds.

What is claimed is:

1. A guide drive device in a warp knitting machine, comprising:

support members attached to machine frames;

guide attaching members;

displacement causing means attached to the support members for selective displacement of said guide attaching members, said guide attaching members being connected to the displacement causing means and installed to be displaceable in a direction which is codirectional with extending knitting needle rows by operation of the displacement causing means; and the guide attaching members being arranged in parallel ranks successive in a direction intersecting with the knitting needle rows, whereby a displacement can be caused for each of the guide attaching members.

2. The guide drive device in a warp knitting machine according to claim 1, wherein each of the guide attaching members is a guide bar attached with at least one thread feeding guide needle.

3. The guide drive device in a warp knitting machine according to claim 2, wherein:

the attaching and holding member is a base bar attached to the support members which has a longitudinal dimension extended in a direction in parallel with the knitting needle rows; and the guide bar is brought into contact with the base bar in a parallel state.

4. The guide drive device in a warp knitting machine according to claim 3, further comprising a slide rail provided at the base bar, said at least one guide needle attached to the guide bar being installed slidably along the slide rail.

5. The guide drive device in a warp knitting machine according to claim 3, wherein the guide bars are installed on both sides of the base bar in said parallel ranks.

6. The guide drive device in a warp knitting machine according to claim 5, wherein said at least one thread feeding guide needle is attached to one side of the guide bar.

7. The guide drive device of a warp knitting machine according to any one of claims 2 through 6, wherein the displacement causing means comprises at least one of a servo motor, a linear motor and a piezoelectric element.

8. A guide drive device in a warp knitting machine comprising:

an attaching and holding member supported by supporting members extending in parallel with knitting needle rows and having rows of guide portions;

thread feed guides;

sliding portions arranged at respective guide portions of the attaching and holding member, slidable in a direction which is codirectional with extending knitting needle rows;

guide attaching members in which the thread feed guides are attached to said sliding portions; and driving long members longitudinally arranged in the direction of the knitting needle rows along the sliding portions of the guide attaching members and fixed to the guide attaching members by being interposed between the sliding portions and the thread feed guides, such that motions, independently from each other, are caused at at least one of the guide attaching members and the thread feed guides, arranged at one of the guide portions.

9. The guide drive device in a warp knitting machine according to claim 8, wherein:

the rows of guide portions in the attaching and holding member are installed in ranks arranged parallel with each other, successive in a direction intersecting with the knitting needle rows, from adjacent to remote relative to thread lead holes located at distal ends of the thread feed guides; and respective guide attaching members arranged in the guide portions are arranged such that positions of at least one of the guide portions and the thread feed guides are successively deviated in a direction intersecting with faces for attaching the guide attaching members, to prevent an occurrence of mutual interference between the respective guide attaching members at vicinities of the guide portions.

10. The guide drive device in a warp knitting machine according to claim 8 or 9, wherein the guide portions are installed to both side faces of the attaching and holding member.

11. The guide drive device in a warp knitting machine according to claim 8 or 9, wherein:

driving long members are provided in relation to one of the guide portions; and each of the guide attaching members arranged at the guide portions is attachably and detachably fixed to at least one of the driving long members.

12. The guide drive device in a warp knitting machine according to claim 8 or 9, wherein guide displacement driving is further stabilized by fixing one of the guide attaching members to the driving long members moving in a same way.

13. The guide drive device in a warp knitting machine according to claim 8 or 9, wherein the driving long member is a wire connected to driving means.

* * * * *